US005438625A

United States Patent [19]

Klippel

[11] Patent Number: 5,438,625

[45] Date of Patent: Aug. 1, 1995

[54] ARRANGEMENT TO CORRECT THE LINEAR AND NONLINEAR TRANSFER BEHAVIOR OR ELECTRO-ACOUSTICAL TRANSDUCERS

[75] Inventor: Wolfgang Klippel, Dresden, Germany

[73] Assignee: JBL, Incorporated, Northridge, Calif.

[21] Appl. No.: 867,314

[22] Filed: Apr. 9, 1992

[30] Foreign Application Priority Data

Apr. 9, 1991 [DE] Germany ..... 41 11 884.7

[51] Int. Cl.[6] ..... H04R 3/00

[52] U.S. Cl. ..... 381/96; 381/98; 381/59

[58] Field of Search ..... 381/96, 59, 98, 103

[56] References Cited

U.S. PATENT DOCUMENTS 4,709,391 11/1987 Kaizer et al. ..... 381/96
5,181,251 1/1993 Schultheiss et al. ..... 381/96
5,185,805 2/1993 Chiang ..... 381/96

FOREIGN PATENT DOCUMENTS 0168078 6/1985 European Pat. Off. .
1031145 6/1963 United Kingdom .

OTHER PUBLICATIONS

Hall, Design Considerations for an Accelerometer-Based Dynamic Loudspeaker Motional Feedback Sytem.

Klippel, Nonlinear Large-Signal Behavior of Electrodynamic Loudspeakers at Low Frequencies.

Kaizer, Modeling of the Nonlinear Response of an Electrodynamic Loudspeakers by a Volterra Series Expansion.

*Primary Examiner*—Forester W. Isen
*Attorney, Agent, or Firm*—Jones, Day, Reavis & Pogue

[57] ABSTRACT

This invention regards an arrangement to correct the linear and nonlinear transfer behavior of electro-acoustical transducers, consisting of an electro-acoustical transducer, a distortion-reduction network connected to its input terminals, and a support system to fit the distortion-reduction network to the transducer. The distortion-reduction network shows nonlinear transfer characteristics obtained from modelling the transducer and thus changes the electrical signal such that the nonlinear effects of the network compensate for the nonlinear behavior of connected transducer. The result is an overall system with reduced distortion and improved linear transfer behavior. A fitting technique and system is used to change the parameters of the electrical network automatically to fit the actual transfer characteristics of the distortion reduction system to the transducer. Several mechanisms, unique to each transducer, are responsible for generation of nonlinear distortion.

50 Claims, 9 Drawing Sheets

FIG. 3
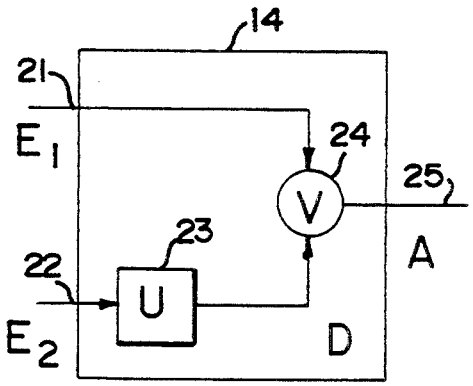
FIG. 4
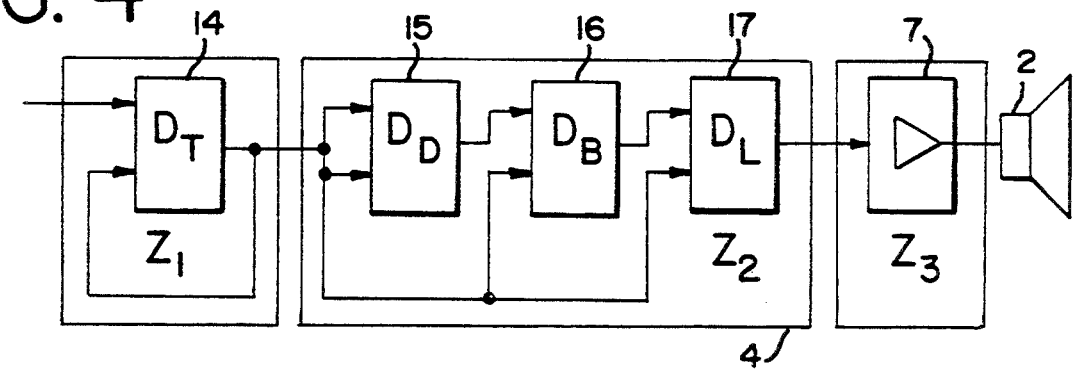
FIG. 5
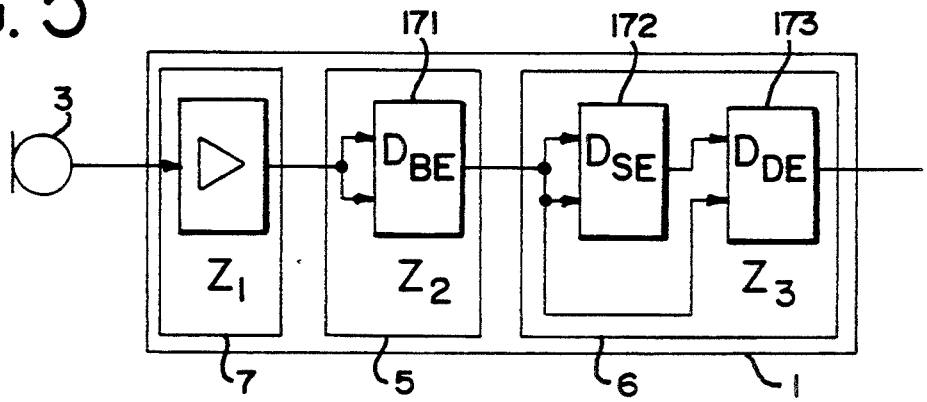
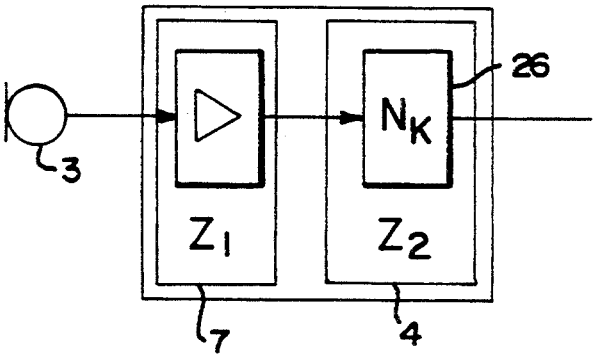
FIG. 6

ARRANGEMENT TO CORRECT THE LINEAR AND NONLINEAR TRANSFER BEHAVIOR OR ELECTRO-ACOUSTICAL TRANSDUCERS

BACKGROUND OF THE INVENTION

1. Field of the Invention

This invention regards an arrangement to correct the linear and nonlinear transfer behavior of electro-acoustical transducers, consisting of an electro-acoustical transducer, a distortion-reduction network connected to its input terminals, and a support system to fit the distortion-reduction network to the transducer. The distortion-reduction network shows nonlinear transfer characteristics obtained from modelling the transducer and thus changes the electrical signal such that the nonlinear effects of the network compensate for the nonlinear behavior of connected transducer. The result is an overall system with reduced distortion and improved linear transfer behavior. A fitting technique and system is used to change the parameters of the electrical network automatically to fit the actual transfer characteristics of the distortion reduction system to the transducer. Several mechanisms, unique to each transducer, are responsible for generation of nonlinear distortion.

The primary nonlinear distortion of an electrodynamic transducer (loudspeaker, head phone, microphone, technical actuators) is caused by displacement varying parameters. Transducers using wave guides (e.g. horns) show additional distortion based on nonlinear compression- and flow characteristics. Electrostatic microphones (condenser type) exhibit nonlinear distortion due to varying electric charges on the plates.

Reducing nonlinear signal distortion improves subjective listening impression in electro-acoustical recording and reproduction of music and increases the linearity of the output. The fields of measurements and active noise reduction require highly linear transducers.

Additionally, in noise cancelling systems, non-compensated non-linear distortion reduces the effectiveness of the system. Improved transducer design can result in better linearity but at a higher cost and with reduced efficiency. By adding an electric compensation system, transducer distortion can effectively be reduced and the linear and nonlinear transfer response improved.

2. Description of Related Art

The UK patent 1,031,145 for electro-acoustical transducers suggests the use of negative feedback. This method requires an electrical, mechanical or acoustical signal derived from the transducer or the radiated sound. This signal is compared with the electrical input signal and the error signal is used for driving the transducer.

Using negative feedback has the advantage that it is not necessary to know the exact nature of the nonlinearity and that the system also functions when the nonlinearity changes. However, the necessary pick-up systems are expensive, sensitive and have certain transfer characteristics which have to be compensated for by an appropriate distortion-reduction network. The danger of possible clipping also requires a protection system. Hall, D. S., Design Considerations for an Accelerometer Based Loudspeaker Motional Feedback System, 87 Audio Eng. Soc. Cony., New York October 1989 (Preprint 2863). All these problems have prevented broad application of this method. Consequently, it is desirable to realize a nonlinear correction system without permanent signal feed back.

By modeling the nonlinear characteristics of the transducer, the nonlinear transfer function can be described. Using these characteristics, a filter with the inverse transfer function can be designed which will compensate for the nonlinear behavior of the transducer.

One way of modeling the nonlinear transfer behavior of a transducer is based on the functional series expansion (e.g. VOLTERRA-series expansion). This is the most powerful technique to describe the second- and third-order distortions of nearly linear systems at very low input signals. However, if the system nonlinearities cannot be described by the second- and third-order terms of the series, the transducer will deviate from the model resulting in poor distortion reduction. Moreover, to use a Volterra-series the input signal must be sufficiently small to guarantee the convergence of the series according to the criterion of Weierstrass.

This theory was first applied to transducers by Kaiser, A. J., Modeling of the Nonlinear Response of an Electrodynamic Loudspeaker by a Volterra Series Expansion, J. Audio Eng. Soc. 35 (1987) 6, S. 421. In the small-signal domain, a good agreement between measured and calculated distortion was found, but at a higher level of input power there were effects which could not be explained by the second- and third-order VOLTERRA-series expansions. Klippel, W., The Large-Signal Behavior of Electrodynamic Loudspeakers at Low Frequencies, 90 AES Convention Paris 1991, preprint 3049.

If the VOLTERRA-series expansion of an any causal, time invariant, nonlinear system is known, the corresponding compensation system can be derived. Schetzen, M., The Volterra and Wiener Theories of Non-Linear Systems (Wiley, New York, 1980). From the VOLTERRA-series expansions, Kaiser derives an "Arrangement for converting an electric signal into an acoustical signal or visa versa and a nonlinear network for use in the arrangement" as described in U.S. Pat. No. 4,709,391 to Kaiser. Kaiser's arrangement comprises at least two circuit branches in parallel. One circuit branch compensates for the first order or linear distortion while each other circuit branch compensates for a different higher order distortion. This arrangement has a parallel structure according to the series properties of the functional series expansion (e.g. VOLTERRA-series expansions). The individual branches represent linear, quadratic, cubic or higher-order nonlinear networks and compensate for the appropriate distortion systems in the transducer model. The output of each branch is then added together to produce the output signal. This concept does not consider the specific characteristics of the transducer and is limited to second- and third-order correction systems in practice.

At low input levels, this system adequately compensates for non-linearities however, at higher levels the transducer deviates from the ideal second- and third-order model resulting in increased distortion of the transfer signal. In theory, a Volterra series can compensate perfectly for the transducer distortion, however, perfect compensation requires an infinite number of terms and thus an infinite number of parallel circuit branches. Adding some higher order compensation elements can increase the system's usable dynamic range. However, because of the complexity of elements required for circuits representing orders higher than third, realization of a practical solution is highly complex.

Recognizing the impracticability of higher order terms, this invention uses a different approach. Instead of a generic solution, this invention models the non-linear distortion characteristics of the transducer. Once the characteristics of the distortion are identified, a system having opposite characteristics can be created and used to compensate for the distortion in the transducer. Rather than the imperfect distortion reduction accomplished by Kaiser, this system creates a filter representing, within the scope of accuracy of the measurement of the characteristic of the transducer, a perfect distortion reduction network for the particular transducer. Fitting a nonlinear-distortion reduction network to the acoustical transducer has not been discussed in any literature, and no methods, supporting systems or automated procedures have been developed.

The goal of this invention is to create a distortion-reduction network without permanent feedback, which allows complete, automated (self learning) compensation of nonlinear distortion at small and large signal amplitudes (the transducer's full dynamic range). Moreover, as a system based on modeling the characteristics of the transducer, this invention be realized with fewer elements and less complexity than a Volterra series correction system.

SUMMARY OF THE INVENTION

This invention corrects the linear and nonlinear transfer behavior of electro-acoustical transducers, consisting of an electro-acoustical transducer, a distortion-reduction network connected to its input terminals; and a support system to fit the distortion-reduction network to the transducer. The distortion-reduction network shows nonlinear transfer characteristics obtained from modelling the transducer and thus changes the electrical signal such that the nonlinear effects of the network compensate for the nonlinear behavior of the connected transducer. The result is an overall system with reduced distortion and improved linear transfer behavior. A fitting technique and system is used to change the parameters of the electrical distortion reduction network automatically to fit the actual transfer characteristics of the distortion reduction system to the transducer. Several mechanisms, unique to each transducer, are responsible for generation of nonlinear distortion.

The invention implements the distortion reduction network in one of three ways. The first technique uses at least two subsystems containing distortion reduction networks for particular parameters placed in series. These subsystems contain distortion reduction circuits for the various parameters of the transducer and are connected in either a feedforward or feedback arrangement.

The second implementation of the network consists of least one subsystem containing distortion reduction circuits for particular parameters where at least one subsystem contains a multiplier and the subsystems are arranged in a feedforward structure. If more than one subsystem is used, the subsystems are arranged in series.

A third implementation of the network consists of a single subsystem containing distortion reduction circuits for particular parameters connected in a feedback arrangement.

BRIEF DESCRIPTION OF THE DRAWINGS

FIG. 3: Structure of the nonlinear, dynamic three-port D, FIG. 4: Structure of the distortion-reduction network for an electrodynamic loudspeaker (woofer system), FIG. 5: Structure of the distortion reduction network for an electrodynamic microphone, FIG. 6: Structure of the distortion reduction network for a condenser microphone.

DESCRIPTION OF THE PREFERRED EMBODIMENT

According to the invention, the electro-acoustical transducer is described by a lumped parameter model. For instance, the moving parts (diaphragm, voice coil, suspension) are described by a single element with one parameter (moving mass). The moving mass remains constant but the parameters of other elements (e.g. damping, stiffness of suspension, B1-product, etc.) vary with time. The changes, caused by aging, fatigue and warming show up as long term processes, which change the linear transfer behavior of the transducer, but do not cause nonlinear signal distortion. Parameters dependent on displacement, current, voltage, velocity and sound pressure result in known nonlinear distortion of the transferred signal.

The transfer behavior can be completely described by a nonlinear integro-differential equation (IDG). The transfer function of the distortion reduction system is derived directly from the IDG and can be embodied into a network. This network is specifically configured for each transducer which results in complete compensation of nonlinear distortion over the transducer's full dynamic range. The advantage of this invention is the realization of simple but very effective distortion reduction networks that require a minimum number of elements.

The problem of fitting the distortion reduction networks to the transducer was solved with the help of an additional system. A temporarily activated fitting system facilitates automatic determination and adjustment of the optimum distortion-reduction parameters. For the transducer's dynamic range and bandwidth the desired linear transfer behavior and a reduction of nonlinear distortion can be achieved.

Figure 7A:
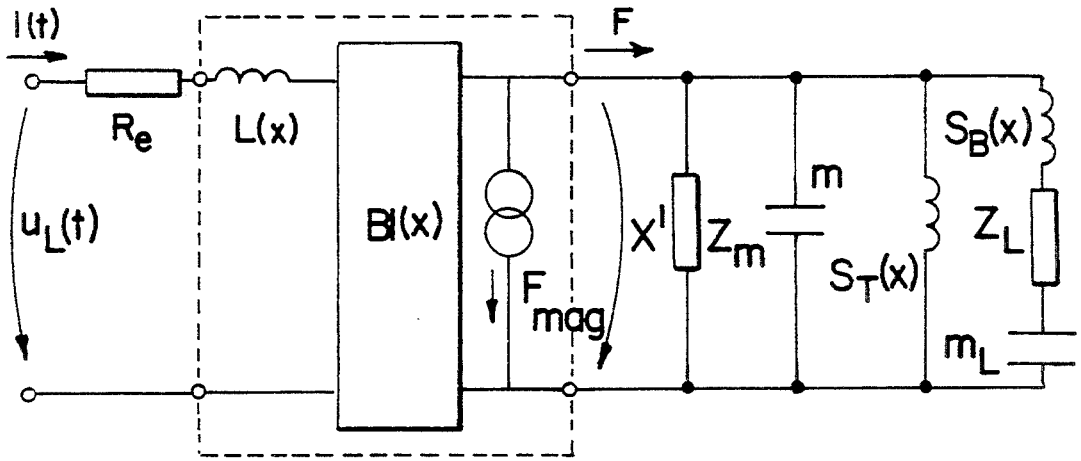
FIG. 7*a*: Equivalent circuit with lumped parameters of electrodynamic loudspeaker.

A signal flow diagram is useful to illustrate the generation of nonlinear distortion in the transducer as well as the derivation of a distortion reduction system. The example of a low frequency transducer with voltage drive shall be presented. The electromechanical equivalent circuit (FIG. 7*a*) is shown as a signal flow diagram (FIG. 7*b*) by the nonlinear IDG, which consists of a nonlinear transfer system (152) followed by a linear transfer system (153). The linear system (153) consists of an electromechanical system (144) with a transfer function X(s) and a following mechanic-acoustical system with a transfer function H(s).

The nonlinear system (152) connected to the input of the linear system (153) describes the generation of the nonlinear signal distortion. The nonlinear system (152) consists of nonlinear, dynamic transfer systems (two-ports 147–151) and one linear transfer system (two-port 167), which also shows the transfer function X(s) and additional combining elements (139–143, 145).

The linear and nonlinear transfer systems have one input 154 and one output (at the output of element 146), the combining elements (139–143) have two signal inputs (either 154 or an output of the previous combining element and the output of one of the elements 147–151) and one signal output (of element 145). The output of each transfer element (147–151) is connected to the input of a combining element (139, 143–145). The corresponding parts are defined in the following as three-port. Each three-port represents exactly one mechanism of nonlinear distortion.

The three-ports that correspond to the displacement varying parameters (induction, damping, the electromagnetic motor force and stiffness) use summing elements as combining elements (139, 141, 142, 143). Surprisingly, the displacement varying electro-dynamic motor force leads to a multiplier (140). The three-port that describes the Doppler distortion contains a controllable time delay element (145) as a combining element.

All three-ports are connected to each other in a defined structure with the output of the preceding combining element connected to the first input of the following combining element, which leads to a series connection of all three-ports. The three-port (147, 139), which describes the effect of varying inductance is first, followed by the three-port of the electro-dynamic motor force (148, 140) and the three-ports corresponding to the electromagnetic motor (150, 142), the nonlinear damping (141, 149) and the stiffness (143, 151). In the last place, in front of the linear system (144, 146) is the three-port (145, 167) corresponding to the generation of the Doppler-distortion in the acoustical system. The inputs of all nonlinear sub-systems and the linear transfer system (167) are connected to the signal input of the time delay element (145). The transfer systems (147–151) are controlled by a positive signal feedback. The three-port of the Doppler distortion (145, 167) represents a feedforward structure. The feedback structure in the transducer determines the known large-signal effects (amplitude compression and phase variation of the fundamental and the distortion products). The Doppler-distortion generated at the output of the delay element (145) does not influence the mechanical vibration of the diaphragm.

The nonlinear transfer system (152) consists of two series connected, nonlinear sub-systems (139–143 and 147–151 connected to 145, 167) one with feed forward (145, 167) and one with a feedback structure (147–151). The nonlinear transfer system (152) represents the generation of nonlinear distortion in the output signal. This effect can be completely compensated for by a certain distortion-reduction system (FIG. 20*a*), which is connected in front of the transducer.

Figure 7B:
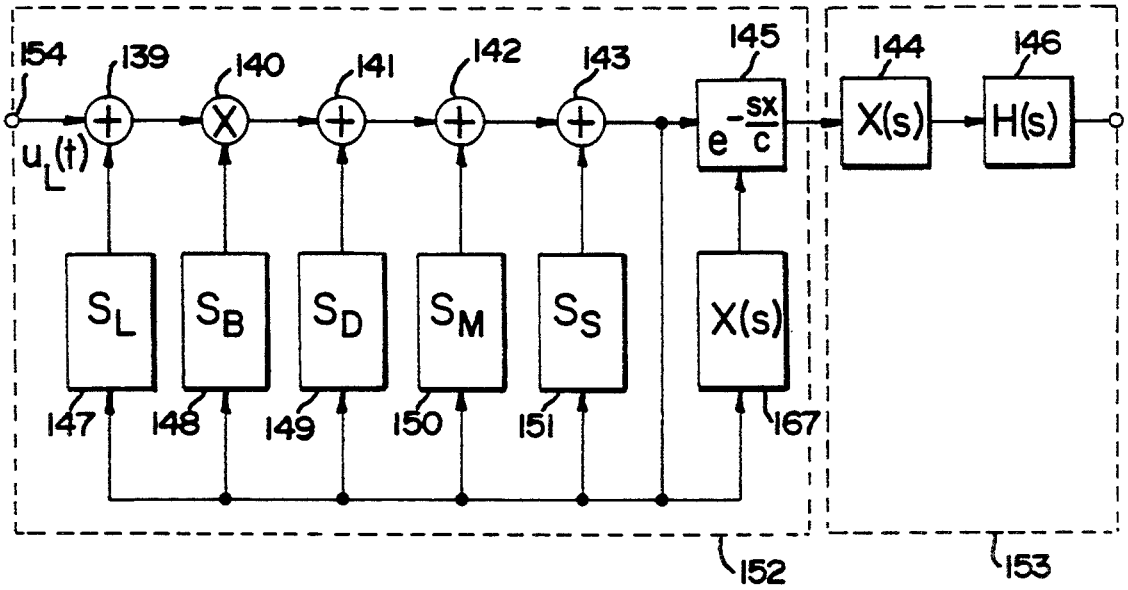
FIG. 7*b*: Describes the transfer behavior of an electrodynamic loudspeaker by a signal flow diagram.

This invention derives the distortion-reduction network comprised of the transfer elements $S_L$ (166), $S_B$ (165), $S_D$ (164), $S_M$ (163), $S_S$ (162) and X(s) (161), which are identical to the nonlinear and linear transfer systems of the transducer (147–151, 167) in the transducer signal flow diagram (FIG. 7*b*). Each of these transfer elements is connected to a combining element. The combination of both is called a three-port. Corresponding three-ports in the distortion reduction network and in the transducer model (see FIG. 7*b*) have exactly inverse properties and all combining elements have the inverse operation with negative instead of positive feedback or vice versa.

The summing elements (139, 141–143 in FIG. 7*b*) correspond to subtracting elements (160, 156–158, in FIG. 20*a*), the multiplier (140) corresponds with the dividing element (159), and the controllable signal delay element (145) has a corresponding delay element with reversed control characteristics.

Figure 20A:
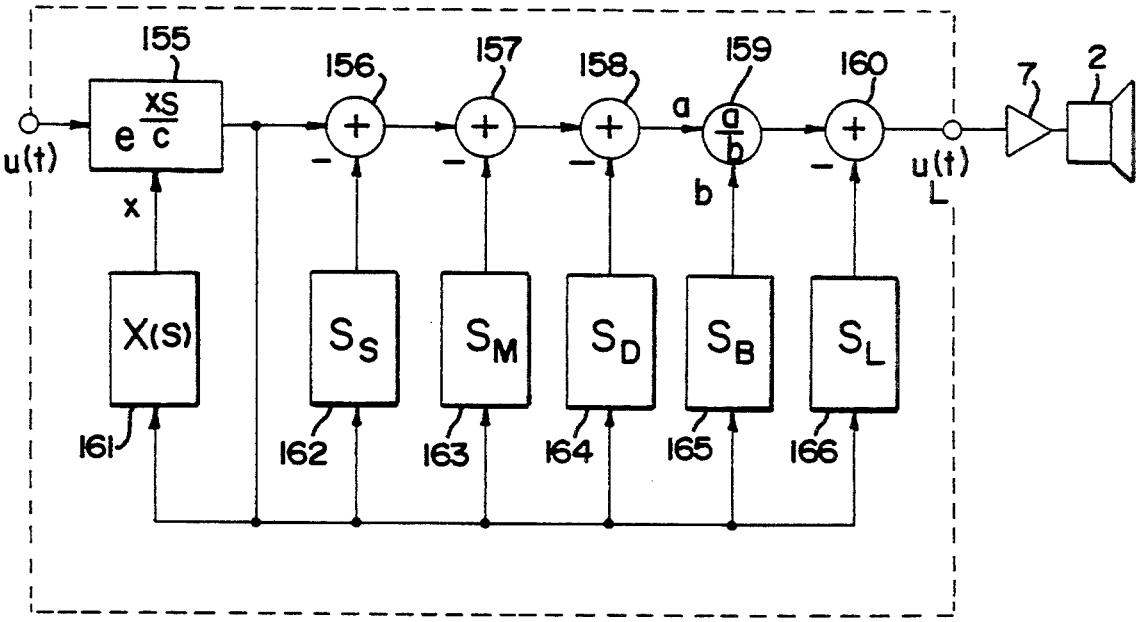
FIG. 20*a*: Signal flow diagram (basic structure) of a distortion reduction system for an electrodynamic loudspeaker.

All three-ports in the distortion-reduction network have two inputs and one output. They are linked in an exact mirror-image sequence of FIG. 7*b* by using one of their inputs and the output of every three-port. The other input of the three-port (input of the transfer elements 161–166) is connected to the output of the signal delay element 155. Note that the feedback part in transducer model (FIG. 7*b*) corresponds with a feed forward part in the distortion reduction system (FIG. 20*a*). Similarly, the feed forward Doppler distortion model (145, 167 in FIG. 7*b*) corresponds with a feedback system (155, 161 in FIG. 20*a*) for performing distortion reduction. The complete distortion reduction network consists of two series connected nonlinear subsystems.

This network structure allows the effects of corresponding three-ports to cancel the corresponding distortion of the transducer. For example, the addition (139) of nonlinear induction distortion (147) to the signal in the transducer is compensated for by a substraction (160) of the same signal in the distortion reduction system in FIG. 20*a*. The multiplication in the transducer model (140) in FIG. 7*b* is compensated for by a division (159) of the same signal in the distortion reduction system in FIG. 20*a*. Similarly, the system compensates for the effect of all the other three-ports. Using this cancelling effect and according to the type of electro-acoustical transducer, a clearly defined network structure is derived. No matter what network structure is derived, all circuit structures have a distortion reduction network consisting of transfer elements connected in series (cascade), where at least one transfer element (two-port) shows a nonlinear transfer behavior between its input and output terminals.

Figure 1A:
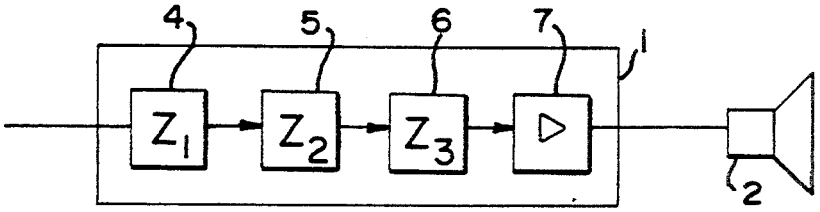
FIG. 1: Basic circuit of the distortion-reduction network for loudspeakers (a) and microphones (b)
Figure 1B:
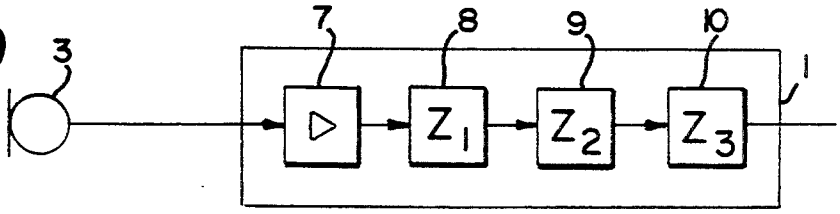

Complete compensation of certain, simultaneously active, nonlinear causes of distortion (for example Doppler-distortion and force factor at the low frequency transducer or force factor and damping/suspension at the electro-dynamic microphone) can only be possible through a series connection (cascade) of several nonlinear transfer elements (see also FIG. 1). Serial connection of the non-linear transfer elements in the distortion reduction networks is obtained by connecting the output of the first element to the input of the next element and so on.

Each nonlinear transfer element (two-ports $Z_1$,$Z_2$,$Z_3$) or distortion reduction network is a frequency independent system without memory or a dynamic frequency dependent system. Each dynamic, nonlinear two-port Z comprises at least one transfer three-port D (see (14) in FIG. 2*a* or FIG. 2*b*), which corresponds to a nonlinear distortion mechanism in the transducer and is used to compensate for that nonlinear distortion.

Each three-port D is a dynamic, nonlinear transfer element with two signal inputs $E_1$, $E_2$ and one output A (shown in detail in FIG. 3) and consisting of one nonlinear dynamic transfer element (two-port U (23)) and one combining element V (24) without memory, which operates (e.g. add or multiply) on the input signals to produce the output signal. The input $E_1$ of the three-port D is directly connected to the input of the combining element, V (24), and the other input $E_2$ of the three-port D is connected to the second input of the combining element V (24) via the two-port U (23) and the output of the combining element V (24) is connected to the output 25 of the three-port D. The two-port U (23) represents the physical properties of the variable transducer parameter and its effect in the functional structure of the transducer.

Figure 2A:
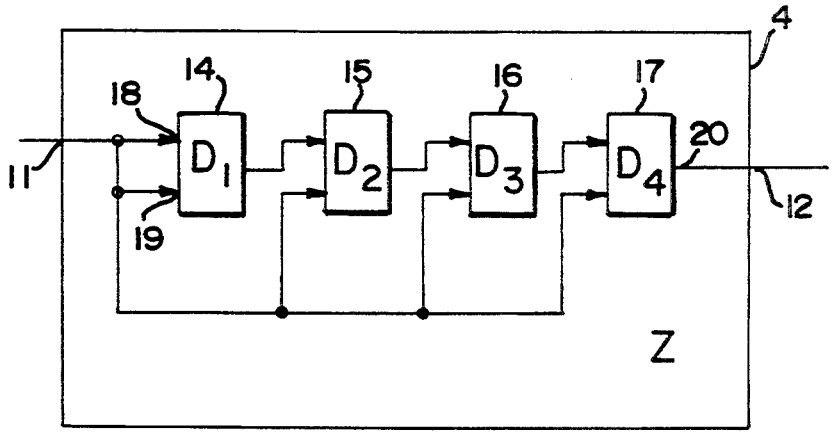
FIG. 2*a*: Two-port Z containing nonlinear, dynamic three-ports D connected in a feed forward structure.
Figure 2B:
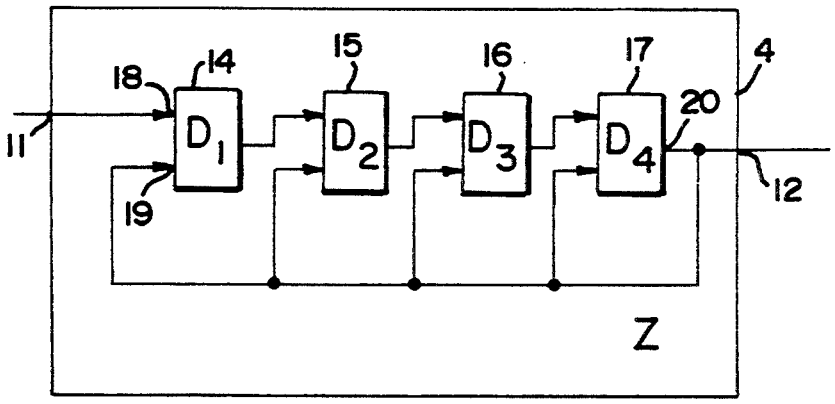
FIG. 2*b*: Two-port Z containing nonlinear, dynamic three-ports D connected in a feed back structure.

If several three-ports are located between the input (18) and the output (20) of any of the two-port Z (4, 5, 6), they are connected in series (see FIG. 2*a* and 2*b*). The corresponding input $E_1$ (18) and output A (20) and the remaining input $E_2$ (19) of the three-ports as shown in FIG. 3 is either connected with the input (18) of the two-port Z (4 in FIG. 2*a*) in a feed forward arrangement or with the output (20) of the two-port Z in a feedback arrangement (4 in FIG. 2*b*).

All dynamic nonlinear transfer elements (two-port Z (4), U (23 in. FIG. 3) and the three-port D (14) are modeled from dynamic linear two-ports (167) and/or nonlinear two-ports N (147–151) without memory (FIGS. 9–19) and/or combining elements (e.g. summing elements, multipliers).

The independent variable parameter of the dynamic linear two-ports (167) (linear filter parameter), FIG. 7*b*, and of the nonlinear two-ports (147–151) without memory (nonlinear parameter) are determined by measurements of the resulting transfer behavior (transducer with distortion reduction network) with the help of a fitting arrangement. This is temporarily or permanently connected to the transducer-distortion-reduction-system and automatically fits the distortion-reduction network to the corresponding transducer.

The distortion-reduction network shall be specified for use with an electro-dynamic loudspeaker mounted in a vented or closed box-system. From an equivalent circuit with lumped elements, the nonlinear integro-differential equation (IDG) is developed. Then the transfer function of the distortion reduction network is determined and realized as a circuit structure. The nonlinear equivalent circuit (see FIG. 7*a*) differs from a linear one by the presence of current- and displacement varying parameters.

The displacement varying stiffness of diaphragm $S_T(X)$ and the stiffness of the coupled air volumes $S_B(X)$ is combined into constant total stiffness $S_o$ and a displacement varying part s (x):

$$s_0+s(x)=s_T(x)+s_B(x). \tag{1}$$

The electro-dynamic B1-product is assumed in linear modeling as a constant $$B1=f(x)=\text{const.}=b_0 \tag{2}$$

but here the dependence on displacement is considered by $$B1=f(x)=B_1(x). \tag{3}$$

The voice coil inductance L(x) and the electro-magnetic motor force $F_{MAG}(i,x)$ vary with displacement.

The elements with constant parameters of the mechanical system (moving mass m, stiffness $s_o$, resistance $z_M$) and of the acoustic system (e.g. for a vented box system: moving air mass $m_L$ in the vent, resistance $z_L$, stiffness $s_B$ of enclosed air) are combined in the impedance term:

$$J(s) = m \cdot s^2 + z_M \cdot s + s_0 + \frac{1}{\frac{1}{m_L \cdot s^2} + \frac{1}{z_L \cdot s} + \frac{1}{s_B}} \tag{4}$$

Using the Laplace operator s, the inverse Laplace transformation $\mathcal{L}\{\ \}$ and convolution operator *, the integro differential equation (IDG) for a constant current drive can be given:

$$B_1(x) \bullet i_L(t) = \mathcal{L}^{-1}\{J(s)\} * x + s(x) \bullet x - \tfrac{1}{2} i_L(t)^2 \frac{dL(x)}{dx} \tag{5}$$

The multiplication of two time signals (shown by a point operator) is separated from the convolution operation. By connecting a suitable distortion reduction system with the general transfer function to the transducer terminals $$i_L(t)=f(i(t)) \tag{6}$$

the overall system can be linearized and the following linear equation (IDG) can be obtained:

$$b_o \bullet i(t)=\mathcal{L}\{J(s)\}*x(t). \tag{7}$$

By combining equations (5)–(7), the transfer function of the distortion reduction network can be specified:

$$i_L(t)=[i(t)+N_S(x)\cdot x+i(t)^2\cdot N_M(x)]\cdot N_B(x) \tag{8}$$

Since the total system meets the linear IDG (7), the time related signal x(t) corresponding to the displacement can be synthesized by a linear network (low-pass)

$$x(t)=\mathcal{L}\{X(s)\}*i(t) \tag{9}$$

with the following transfer function $$X(s) = \frac{b_0}{J(s)}. \tag{10}$$

For the frequency independent, nonlinear functions $N_S(x)$, $N_M(x)$ and $N_B(x)$, the following relations to the displacement varying transducer parameters can be stated:

$$N_S(x) = \frac{s(x)}{b_o}, \tag{11}$$

$$N_M(x) = -\frac{1}{2b_o}\ \frac{dL(x)}{dx}, \tag{12}$$

$$N_B(x) = \frac{b_o}{B_1(x)}. \tag{13}$$

The constant current drive of the electro-dynamic transducer system requires an amplifier with voltage current converter and demands additional means to equalize the sound pressure response. However, nonlinear distortion reduction is simplified. In practice, the voltage-current conversion is made after the nonlinear distortion reduction.

For a voltage drive of the transducer, the effect of voice coil resistance $R_e$ and voice coil inductance L(x) results in a complex nonlinear differential equation and to a more complex distortion reduction system.

The following nonlinear equation (IDG) results from the equivalent circuit with voltage drive:

$$B_1(x) \bullet u_L(t) = R_c \bullet \mathcal{L}^{-1}\{J(s)\} * x + R_c \bullet s(x) \bullet x + B_1(x)\ \frac{d(L(x)\cdot i_L(t))}{dt} + B_1(x)^2 \frac{dx}{dt} - \frac{R_c}{2} \bullet i_L(t)^2 \bullet \frac{d\,L(x)}{dx} \tag{14}$$

By precombining a distortion reduction system with the transfer function $$u_L(t)=f[u(t)] \tag{15}$$

in series to the transducer, the total system is linearized and agrees with the following linear IDG:

$$b_o \bullet u(t)=\mathcal{L}\{R_e \bullet J(s)+b_o^2 \bullet s\}*x \tag{16}$$

By combining equations (14), (15) and (16), the transfer function of the distortion reduction network is derived:

$$u_L(t) = f[u(t)] = \left\{ u(t) + N_s(x) + N_D(x)\frac{dx}{dt} + N_M(x) \bullet i_L(t)^2 \right\} \bullet N_B(x) + \frac{d[i_L(t) \bullet N_L(x)]}{dt} \tag{17}$$

Since the total system meets the linear IDG (16), the displacement equivalent signal (161 in FIG. 20a)

$$x(t)=\mathcal{L}\{X(s)\}*u(t) \tag{18}$$

is synthesized with the support of a linear system (low-pass) with the linear transfer function $$X(s) = \frac{b_0}{J(s) \bullet R_c + s \bullet b_0^2} \tag{19}$$

from the undistorted input signal u(t).

The current signal $i_L(t)$ is generated by the following nonlinear transfer function $$i_L(t) = \left[ \mathcal{L}^{-1}\{I(s)\} * x + \frac{N_s(x)}{R_c} \right] \bullet N_B(x) \tag{20}$$

using the convolution of the displacement signal x(t) with the linear transfer function $$I(s) = \frac{J(s)}{b_0}. \tag{21}$$

The frequency independent, nonlinear functions $N_S$, $N_M$, $N_D$, $N_L$ and $N_B$ show the following relationships to the displacement varying transducer parameters $$N_S(x) = \frac{s(x) \bullet R_c}{b_0}, \tag{22}$$

$$N_M(x) = -\frac{R_c}{2b_0}\ \frac{dL(x)}{dx}, \tag{23}$$

$$N_B(x) = \frac{b_0}{B_1(x)}, \tag{24}$$

$$N_D(x) = \frac{B_1(x)^2}{b_0} - b_0, \tag{25}$$

$$N_L(x) = L(x) \tag{26}$$

The circuits of the distortion reduction system with current and voltage supply can be derived from the nonlinear transfer functions (8), (17) directly. Operation in the time domain is equivalent to the multiplication of two time signals. The convolution with a linear transfer function is performed by a linear system (filter). The nonlinear functions are realized by nonlinear two-ports without memory.

The distortion reduction network contains a three-port $D_S$ (FIG. 9) used for compensation and/or the desired change of the displacement varying stiffness. This three-port consists of a linear, dynamic network X (100), a nonlinear two-port $N_S$ (101) without memory and a summing element (103). The input $E_2$ (22) of the three-port is connected to the input of the two-port X (100). The output of the two-port X (100) (displacement equivalent signal) is connected via the nonlinear two-port $N_S$ (101) with the input of the summing element (103). The second input of the summing element (103) is connected to the input $E_1$ (21) and the output of the summing element is connected to the output A (25) of the three-port $D_S$ (99).

The distortion-reduction network (FIG. 20*a*) also contains a three-port $D_B$ (FIG. 10), which can be used for compensation of the displacement varying B1-product. This three-port consists of a linear, dynamic network X, of a nonlinear two-port $N_B$ (104) without memory and of a multiplying element (105). The first input $E_2$ of the three-port is connected in series via the linear two-port X (100) and the nonlinear two-port $N_B$ (104) to the multiplier (105) input. The second input of the multiplier (105) is connected to the input $E_1$. The output of the multiplier is the output A (25) of the three-port $D_B$ (102).

The distortion-reduction network contains a three-port $D_D$ (109) (FIG. 11), which can be used for compensation and/or the desired change of the displacement varying damping. This three-port consists of a linear, dynamic network X (100), of a differentiator (108), of a nonlinear two-port $N_D$ (106) without memory, of a summing (103) and a multiplying element (107). The input $E_2$ (22) of the three-port is connected via the linear system X with both the inputs of the nonlinear two-port $N_D$ and the differentiator (108). The outputs of the differentiator (108) and the nonlinear two-port $N_D$ (106) are connected via a multiplier (107) to the first input of the summing element (103). The second input of the summing element is connected to the input $E_1$ (21) and its output is the output A (25) of the three-port $D_D$.

The distortion-reduction network contains the three-port $D_M$ (FIG. 12 or 13), which is used to compensate for the electro-magnetic drive. This three-port consists of a linear, dynamic network X (100), of a nonlinear two-port $N_M$ (110) without memory, of a squaring element (168), a multiplying element (169) a summing element (103) and, if driven by a voltage source, a nonlinear network (111).

If the loudspeaker is driven by a constant current source, the input $E_2$ (22) of the three-port (FIG. 13) is connected directly to the input of the squaring element (168) and to the two-port X (100). The output of the two-port X (100) is connected via the nonlinear two-port $N_M$ (110) to the input of the multiplier (169). The output of the squarer (118) is connected to the other multiplier input. The output of the multiplier and the input $E_1$ (21) are summed by (103) and result in the output A (25) of the three-port $D_M$ (97).

If the loudspeaker is driven by a voltage source (FIG. 12), the input signal of the squaring element (168) is equivalent to the input current of the transducer. This is generated with the support of a nonlinear network (111) due to equation (20).

The distortion reduction network (FIG. 14) contains a three-port $D_L$ (98) for compensation of the displacement varying inductance of the transducer with voltage drive. This three-port consists of the linear, dynamic network X (100), of a nonlinear network (111), a differentiator (112), a nonlinear two-port $N_L$ (110) without memory, a multiplier (109) and a summing element (103). The input $E_2$ (22) of the three-port is connected to the input of the non-linear network (111) and via the linear two-port X (100) to the nonlinear two-port $N_L$ (110). The output of the two-port $N_L$ and the output of the above described network (111) are connected to the inputs of the multiplier (109). The output signal is connected via the differentiator (112) to the input of the summing element (103). The second input of (103) is connected with the input $E_1$ (21) and its output is connected to the output A (25) of the three-port $D_L$ (98).

For the simultaneous compensation of the electrodynamic B1-product and other transducer parameters, the compensation three-ports are connected in series using the input (21) and the output (25). Except for the three-port $D_L$ (98) used for inductance compensation, all three-ports are connected to the input of the three-port $D_B$ (16 FIG. 4). The output of the inductance compensating three-port $D_L$ (98) is connected to the transducer inputs of the loudspeaker.

The circuit structure of the compensation three-ports directly results from the analytical structure of the transfer function (large parentheses in 5 and 12). They correspond with the mirror-symmetry between the distortion reduction network (signal flow diagram in FIG. 20*a*) and the structure of the transducer model (signal flow diagram FIG. 7*b*). The distortion caused by displacement varying parameters can only be compensated for by this sequence.

Based on the displacement of the diaphragm, not only the electrical and mechanical parameters change, but also the acoustical radiation conditions. The displacement varies the distance between the instantaneous diaphragm position and a fixed point in the main radiation direction (on-axis) and causes Doppler distortion (as described in G. L. Beers and H. Belar, "Frequency-Modulation Distortion in Loudspeakers", J. Audio Eng. Soc., 29, page 320–326, May 1981.

This distortion of the transducer can be compensated by processing the electrical signal. The distortion mechanism is modelled, the necessary transfer function of the distortion reduction network is derived, and the necessary circuit structure is determined.

The existing sound pressure p(t) at the listening point on axis results from convolution of the displacement signal x(t) with the impulse response $$p(t)=h(t, x(t))*x(t) \tag{27}$$

where the impulse response $$h(t, x(t)) = h_0\left(t - T_0 - \frac{x(t)}{c}\right) = h_0(t) * \delta\left(t - T_0 - \frac{x(t)}{c}\right) \tag{28}$$

describes the radiation and propagation of the acoustical signal.

The variable time delay of the signal is taken into account. With help of the Dirac function $\delta(t)$, the variable impulse response is split into the constant impulse response $h_0(t)$ and into a variable signal delay expressed by the quotient of displacement x(t) and speed of sound c and by the mean delay time $T_0$.

By using the linear transfer function X(s) of the linearized total system, the relation between the electrical input signal $u_L(t)$ and the resulting sound pressure $$p(t) = h_0(t) * \mathcal{L}^{-1}\{X(s)\} * \delta\left(t - T_0 - \frac{x(t)}{c}\right) * u_L(t) \tag{29}$$

can be described.

By predistorting the electric input signal $u_L(t)$ by the filter function $$u_L(t) = f[u(t)] = \delta\left(t - T_1 + \frac{x(t)}{c}\right) * u(t) \tag{30}$$

the variations in signal delay on axis can be compensated and a linear system with the transfer function $$p(t) = h_0(t) * \mathcal{L}\{X(s)\} * \delta(t - T_0 - T_1) * u(t) \tag{31}$$

is realized. The constant signal delay $T_1$ is adjusted in such a way that the distortion reduction system is causal.

The transfer function of the distortion reduction system (FIG. 24) can be realized with a controllable signal delay element. This element is controlled by a displacement equivalent signal x(t) which is synthesized from the electrical signal $u_L(t)$ by a linear filter with the transfer function X(s). This correction network is described as the three-port $D_T$ (133 in FIG. 24). At the input, $E_1$ (21) is the signal u(t) and the output A (25) is connected via the following correction three-ports to the transducer. The control input $E_2$ (22) is connected to the output A (25) and results in a feedback system (see FIG. 2*b*).

If there are additional nonlinear mechanisms for distortion in the electro-dynamic transducer (e.g. Bl-product, damping, inductance), the corresponding compensating three-ports (see $D_D$(15), $D_B$(16), $D_L$(17) in FIG. 4) must be connected in series after $D_T$(14) to compensate for the nonlinear distortions completely. The resulting total distortion reduction network contains two nonlinear, dynamic transfer elements (two-port $Z_1$ and $Z_2$ in FIG. 4) connected in series. The first transfer element $Z_1$, represents the Doppler distortion reduction of the acoustical system and the second element $Z_2$, the distortion reduction of the electromechanical system. The mirror symmetry of corresponding three-ports in the distortion reduction networks (FIG. 20*a*) and the transducer model (FIG. 7*b*) is obvious.

Figure 24:
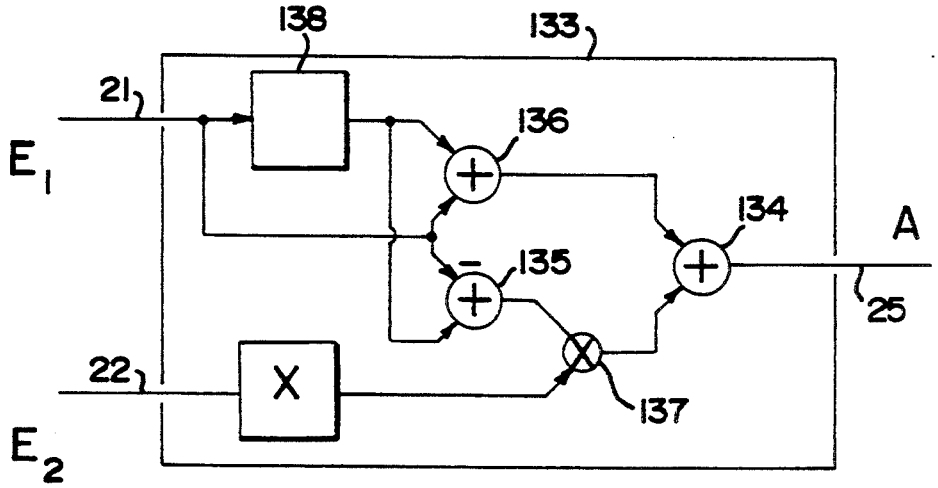
FIG. 24: Three-port $D_T$ for compensation of displacement varying signal delay (Doppler distortion).

FIG. 24 shows one possibility to realize the three-port $D_T$ for reduction of Doppler distortion. The control input $E_2$ (22) of this three-port is connected to the input of the linear filter (100) with linear transfer function X(s). The output is a displacement equivalent signal x(t).

The input $E_1$ (21) is connected to the input of a signal delay element (138) with a constant delay of one clock cycle (e.g. 20 μs). With the support of two summing elements (136,134), one subtracting element (135) and one multiplier (137), an interpolation is done between the delayed and the non-delayed sample based on the instantaneous displacement x(t).

The use of sound directing elements (e.g. horns) with compression type transducers increases the efficiency and reduces the displacement varying distortion. Nonlinear flow and compression characteristics of air can create nonlinear distortion. First, the physical mechanisms shall be explained by modeling the transducer with a horn, then the distortion reduction transfer function and the corresponding circuit structure will be derived.

Two main nonlinear mechanisms can be described by the following lumped parameters. Flow resistance $Z_K$ is dependent on the volume velocity. At low amplitudes, the flow resistance $Z_K(q_K)$ is nearly constant and determined by viscous friction of the air. At higher amplitudes of $q_K$, turbulences occur and result in an increase of the total flow resistance.

The second nonlinear mechanism is developed by the compression of enclosed air. The compliance $N_D$ of the enclosed air volumes V decreases with the increase of pressure $p_D$ in the chamber and can be described through the following relation:

$$N_D(p_D) = \frac{V_0}{\gamma p_0} \bullet \frac{(\gamma + 1)}{\gamma}\left[\frac{\gamma}{(\gamma + 1)} - \frac{p_D}{p_0} + \left(1 + \frac{1}{2\gamma}\right)\left(\frac{p_D}{p_0}\right)^2\right] \tag{32}$$

with the exponent $\gamma = 1.4$ for adiabatic compression and the static air pressure $p_0$.

Figure 8:
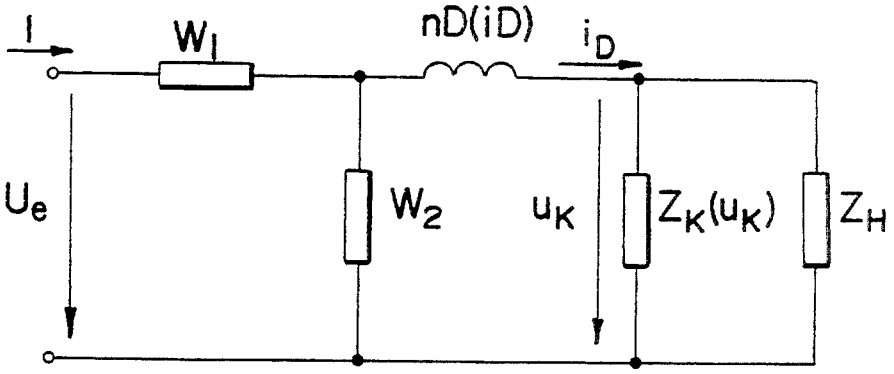
FIG. 8: Equivalent circuit of a horn loaded compression driver.
Figure 9:
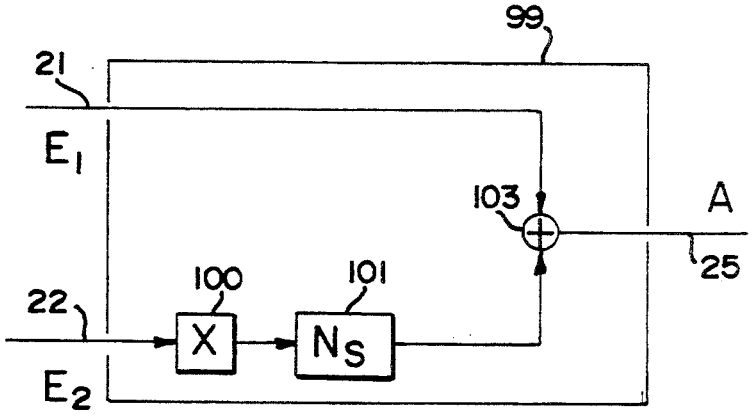
FIG. 9: Three-port $D_S$ for compensation of displacement varying stiffness of a woofer system.
Figure 10:
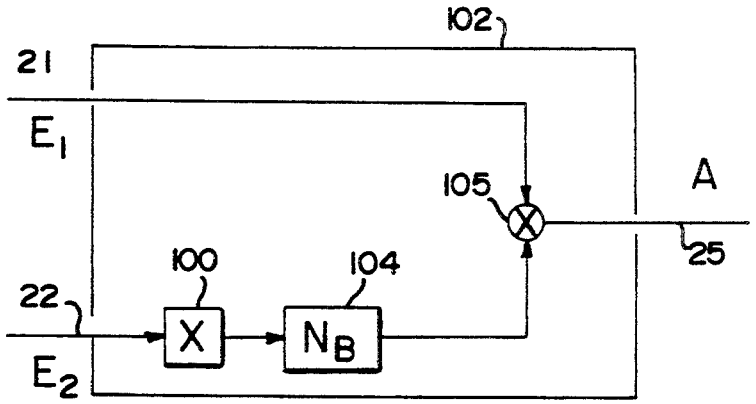
FIG. 10: Three-port $D_B$ for compensation of displacement varying B1-product of a woofer system.
Figure 11:
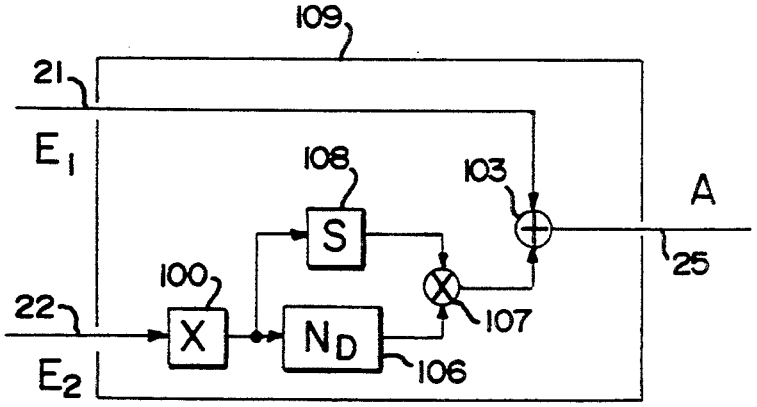
FIG. 11: Three-port $D_D$ for compensation of displacement varying damping of a woofer system.
Figure 12:
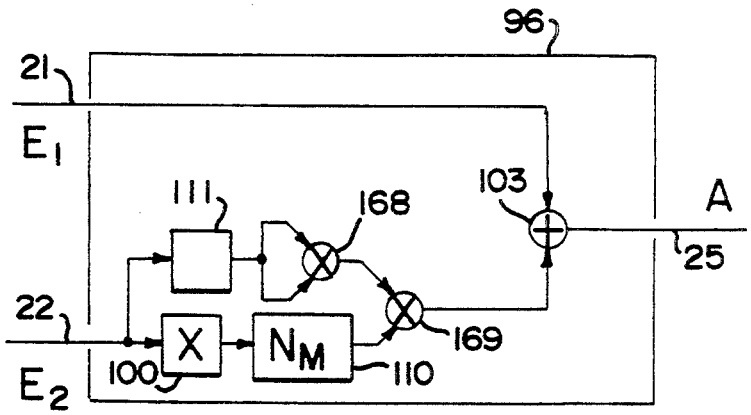
FIG. 12: Three-port $D_{MU}$ for compensation of the electro magnetic attraction force of a woofer system with voltage supply.
Figure 13:
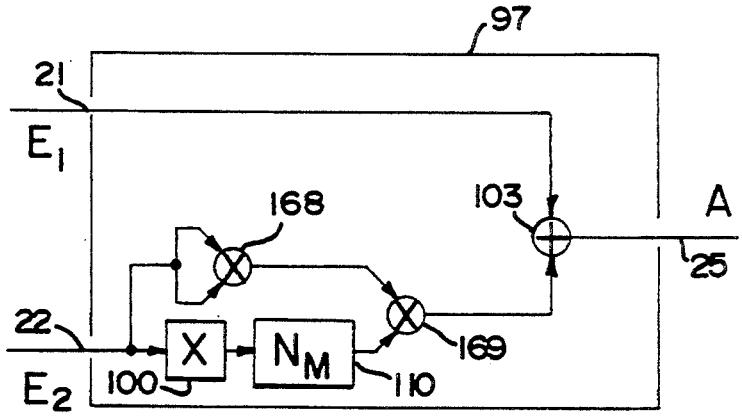
FIG. 13: Three-port $D_{MI}$ for compensation of the electromagnetic attraction force of a woofer system with current supply.
Figure 14:
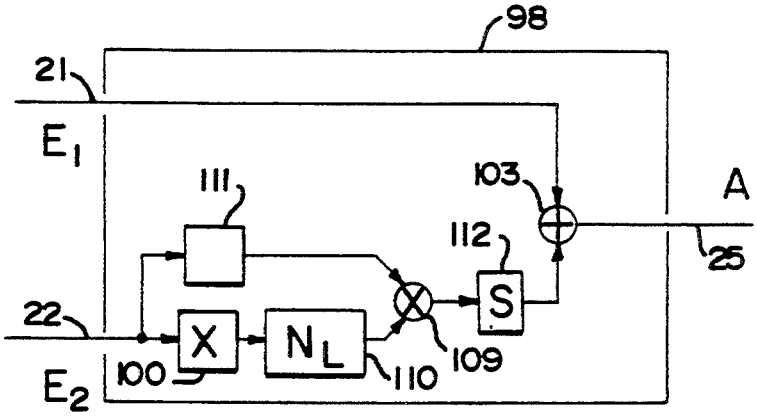
FIG. 14: Three-port $D_L$ for compensation of displacement varying inductance of a woofer system.
Figure 15:
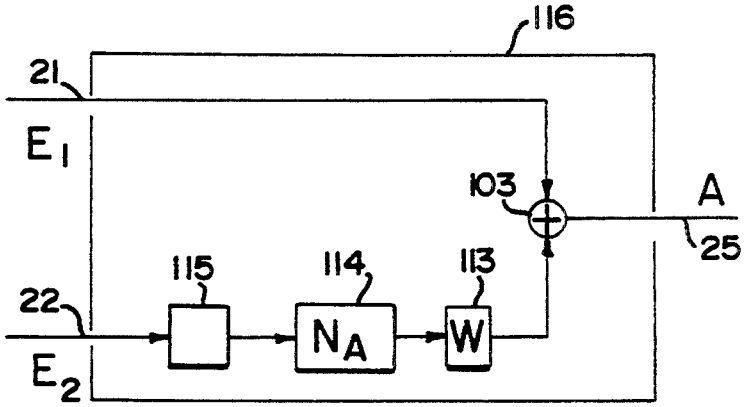
FIG. 15: Three-port $D_A$ for compensation of nonlinear air compression in sound directing elements.
Figure 16:
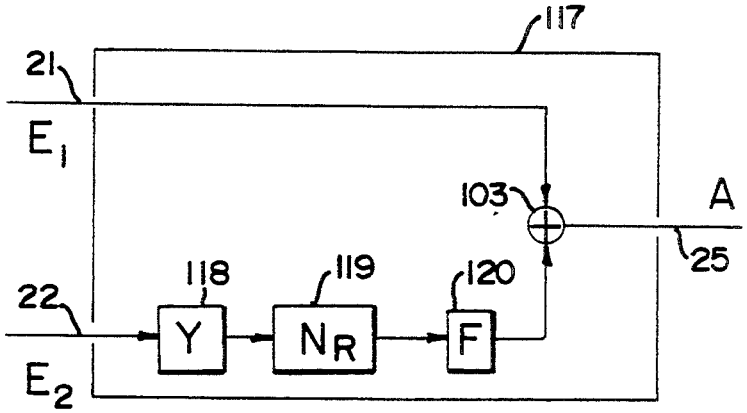
FIG. 16: Three-port $D_R$ for compensation of the varying flow resistance due to turbulence in sound directing elements.
Figure 17:
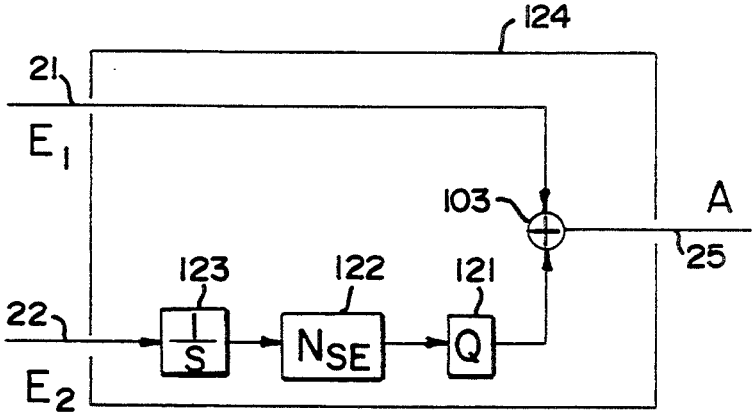
FIG. 17: Three-port $D_R$ for compensation of the displacement varying stiffness of an electrodynamic microphone.
Figure 18:
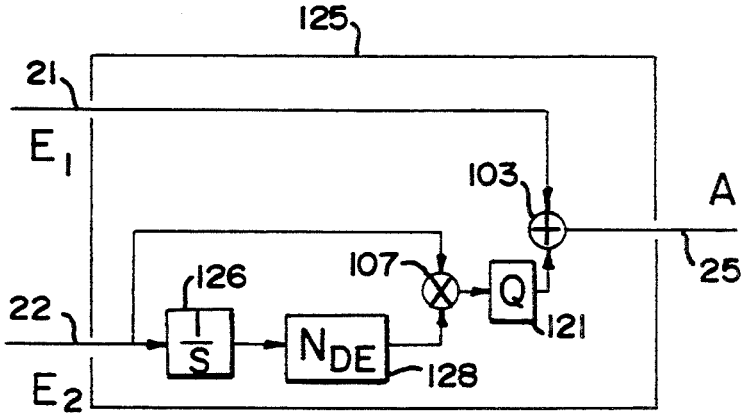
FIG. 18: Three-port DDB for compensation of the displacement varying damping of an electrodynamic microphone.

By transforming all acoustical and mechanical elements to the electric side, the equivalent circuit can be derived (shown in FIG. 8). The electric resistance $R_e$ and inductance L of the voice coil are combined to an impedance $W_1$ (s)

$$W_1(s) = R_e + Ls. \tag{33}$$

The linear elements of the mechanic system (moving mass m, compliance $n_T$ of the mechanic suspension, mechanic resistance $Z_M$) and of the acoustic system (resistance $Z_{BOX}$ and compliance $N_{BOX}$ of the enclosed air behind the diaphragm) are combined in the complex impedance $$W_2(s) = (Bl)^2\left(m \cdot s + \frac{1}{n_T} + z_M + S_M^2 \bullet \left(Z_{BOX} + \frac{1}{N_{BOX} \bullet s}\right)\right) \tag{34}$$

The effect of the horn is described by the horn impedance $Z_H$ at the throat transformed to an equivalent impedance $Z_H$ in the electric equivalent system $$Z_H(s) = \frac{(Bl)^2}{S_M^2 \bullet Z_H(s)}. \tag{35}$$

In the equivalent circuit (FIG. 8), the acoustical compliance $N_D(q_D)$ appears as an inductance $$L_D(i_D) = \frac{(Bl \bullet S_M)^2}{N_D\left(\frac{Bl \bullet i_D}{S_M}\right)} = L_0 + L(i_D) \tag{36}$$

dependent on current $i_D$ and split into a constant part $L_0$ and a varying part $L(i_D)$.

The flow resistance $Z_k(q_k)$ is transformed into an electric impedance $$Z_K(u_K) = \frac{(Bl)^2}{S_M^2 \bullet Z_K\left(\frac{u_K \bullet S_M}{Bl}\right)} = \frac{1}{R_o + R(u_K)} \quad (37)$$

dependent on a constant part $R_0$ and a varying part $R(u_k)$.

Based on the equivalent circuit, the following nonlinear equation can be derived $$u_L - \mathcal{L}^{-1}\{W(s)\} * [L(i_D)\bullet(u_K * \mathcal{L}^{-1}\{Z(s)\}) + L(i_D)\bullet u_K \bullet R(u_K)] - \mathcal{L}^{-1}\{F(s)\} * [u_K \bullet R(u_K)] = \mathcal{L}^{-1}\{W_1(s)\bullet Z(s) + W(s)\bullet Z(s)\bullet L_o + 1\} * u_K \quad (38)$$

with the use of the convolution operator *, the inverse Laplace-transformation $\mathcal{L}\{\ \}$, the Laplace-operator s and the following impedances $$W(s) = s \bullet \left(\frac{w_1(s)}{w_2(s)}\right) + 1, \quad (39)$$

$$F(s) = L_o \bullet W(s) + W_1(s), \quad (40)$$

$$Z(s) = R_o + \frac{1}{Z_H(s)}. \quad (41)$$

By precombining a distortion reduction system with the transfer function $$u_L(t) = f[u(t)] \quad (42)$$

the total system is linearized and the following linear equation (IDG) is obtained:

$$u(t) = \mathcal{L}^{-1}\left\{ W_1(s)\bullet Z(s) + W(s)\bullet\left[Z(s)\bullet L_0 + \frac{1}{s}\right]\right\} * u_k(t) \quad (43)$$

By combining the equations (38), (42), (43) the transfer function of the nonlinear distortion reduction network $$u_L(t) = u(t) + \mathcal{L}\{W(s)\} * N_A(i_D(t)) + \mathcal{L}\{F(s)\} * N_R(u_K(t)) \quad (44)$$

is derived.

Because the total system (loudspeaker and distortion reduction system) corresponds to the linear IDG (43), the control signal $U_k(t)$ $$u_K(t) = u(t) * \mathcal{L}\{Y(s)\} \quad (45)$$

is synthesized from undistorted input u(t) by a linear filter with the transfer function Y(s)

$$Y(s) = \frac{1}{w_1(s)\bullet Z(s) + W(s)\bullet\left[Z(s)\bullet L_0 + \frac{1}{s}\right]} \quad (46)$$

The current $i_D(t)$ is synthesized by a nonlinear system with the transfer function $$i_D(t) = [u_K(t) * \mathcal{L}\{Z(s)\}] + N_R(u_K(t)) \quad (47)$$

The nonlinear functions of the distortion reduction system show the following relationships to the transducer parameters $$N_A(i_D) = L(i_D)\bullet i_D \quad (48)$$

$$N_R(u_K) = u_K \bullet R(u_K) \quad (49)$$

The nonlinear transfer function of the distortion reduction system can be directly transferred into a circuit. The convolution operation of a signal with an constant transfer function (e.g. Y(s), F(s), Z(s), W(s)) corresponds to a linear filter. The nonlinear functions $N_A(i_D)$ and $N_R(u_K)$ are realized by nonlinear transfer systems without memory. The signals are combined according to the algebraic structure of the transfer function (31) with summing elements and multipliers.

This results in the following structure for the three-port $D_A$ (116 in FIG. 15), which performs a compensation of the nonlinear air compression. The input $E_2$ (22) of the three-port $D_A$ is connected via a dynamic, nonlinear system (115) described by equation (38) via a nonlinear element $N_A$ (114) without memory via a linear element (113) with the transfer function W(s) to the input of the summing element (103). The second input of the summing element is connected with the input $E_1$ (21) of the three-port $D_A$ (116). The output of the summing element (103) connected to the output A (25).

The three-port $D_R$ (117 in FIG. 16), which performs compensation of the velocity varying flow resistance, has the following structure. The input $E_2$ (22) of the three-port $D_R$ (117) is connected via a linear filter (118) with the transfer function Y(s), via nonlinear transfer element $N_R$ (119) without memory, via a linear filter (120) with the transfer function F(s) to the input of the summing element (103). The second input of the summing element is connected to the input $E_1$ (21) of the three-port $D_R$ (117). The output of the summing element (103) is connected to the output A (25) of the three-port $D_R$ (117).

In a limited frequency range the circuit can be simplified. By using the relation:

$$Z(s) < W_1(s) < W_2(s), \quad (50)$$

$$Z(s) < R_0, \quad (51)$$

$$z_H(s) \approx z_0 = \text{const.} \quad (52)$$

the transfer function of the linear network (113) becomes $$W(s) \approx s \quad (53)$$

and represents a simple differentiator. The linear networks (120, 115, 118) with the transfer functions $$F(s) \approx W_1(s) \approx \Re\{W_1(s)\} = R_o, \quad (54)$$

$$Z(s) \approx \frac{1}{Z_0}, \quad (55)$$

$$Y(s) \approx \frac{z_0}{R_c + z_0} \quad (56)$$

can be realized as frequency independent amplifiers.

The electro-dynamic receiver (microphone) also produces nonlinear distortion under high sound pressure at low frequencies. First the physical mechanisms will be explained by modeling the electro-dynamic sensor with lumped electrical and mechanical elements and then the distortion reduction network will be derived.

The sound pressure signal $p_m(t)$ is transformed into a force signal F(t) through help of a diaphragm with the surface $S_M$, which drives the mechanical system.

The stiffness $s_T(x)$ of the mechanic suspension and the stiffness $s_B(x)$ of the enclosed air volumes are summed and are split into a constant part $S_o$ and a displacement varying part $S_G(x)$:

$$s_0+s_G(x)=s_T(x)+s_B(x) \tag{57}$$

The B1-product $B_L(x)$ and the total mechanical resistance $z_T(x)$ are considered as displacement varying parameters. The resistance $z_T(x)$ is split into a constant part $z_0$ and into a displacement varying part $z_m(x)$.

All elements with constant parameters (moving mass m, mechanic resistance $z_0$, . . . ) are combined into the mechanical impedance:

$$z(s) = ms + z_0 + \frac{s_0}{s} + \ldots \tag{58}$$

The amplifier, which is connected to the sensor, shows a large enough input impedance so that the resistance and the induction of the voice coil can be neglected.

With the use of the Laplace operators s, the inverse Laplace transformation and the convolution, the nonlinear equation (IDG)

$$F(t) = \mathcal{L}^{-1}\{sz(s)\} + \frac{dx}{dt} \bullet z_m(x) + x \bullet s_G(x) \tag{59}$$

can be derived. The force F(t) is the input signal. The output signal is the voltage $u_L(t)$ on the terminals described by $$u_L(t) = \frac{dx}{dt} \bullet B_1(x) \tag{60}$$

By connecting a distortion reduction system with the transfer function $$u(t)=F(u_L(t)) \tag{61}$$

to the terminals of the transducer, the transfer function of the total system is linearized and the following linear equation is satisfied:

$$u(t) = F(t) * \mathcal{L}^{-1}\left\{\frac{b_0}{z(s)}\right\} \tag{62}$$

By combining equations ((59))–((62)), the transfer function of the nonlinear distortion reduction network $$u(t) = u_B(t) + \mathcal{L}^{-1}\{Q(s)\} * \left[u_B \bullet N_{ZE}\left(\mathcal{L}^{-1}\left\{\frac{1}{s}\right\} * u_B\right) + N_{SE}\left(\mathcal{L}^{-1}\left\{\frac{1}{s}\right\} * u_B\right)\right] \tag{63}$$

with $$Q(s) = \frac{1}{z(s)} \tag{64}$$

and

-continued $$u_B = N_{BE}\left(\mathcal{L}^{-1}\left\{\frac{1}{s}\right\} * u_L(t)\right) \tag{65}$$

is derived.

The nonlinear functions without memory show the following relationship to the sensor parameters $$N_{SE} = \frac{s_G(x) \bullet x}{b_0}, \tag{66}$$

$$N_{DE} = \frac{z_m(x)}{b_0}, \tag{67}$$

$$N_{SE} = \frac{b_0}{B_1(N_U(x))}, \tag{68}$$

where the auxiliary function $N_U(x)$ meets the following relation $$B_1(N_U(x)) \bullet \frac{dN_U(x)}{dx} = 1 \tag{69}$$

The nonlinear transfer function of the distortion reduction system can be directly transformed into a circuit. This circuit consists of two nonlinear, dynamic two-ports $Z_2$ (5) and $Z_3$ (6) connected in series (see FIG. 5). The two-port $Z_2$ (5), connected to the amplifier's output (7), comprises the three-port $D_{BE}$ (171) for compensation of the varying B1-product. The two-port $Z_3$ (6), which is connected to the output of the three-port $D_{BE}$, comprises the three-ports $D_{SE}$ (172) and $D_{BE}$ (173) for the compensation of displacement varying damping and stiffness.

Figure 19:
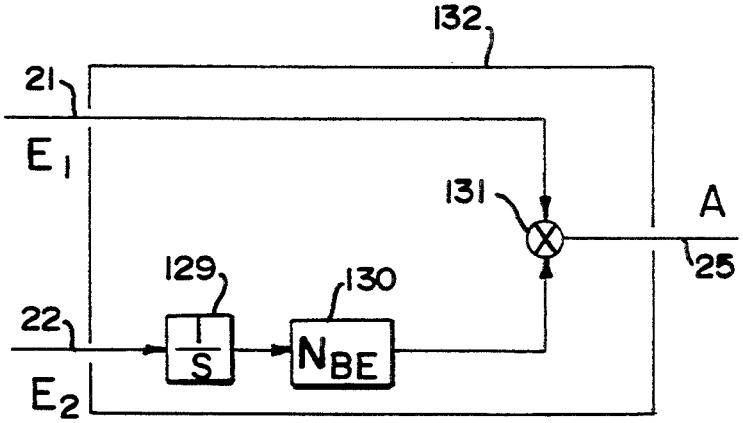
FIG. 19: Three-port $D_{BE}$ for compensation of the displacement varying B1-product of an electrodynamic microphone.

The elements of the three-port $D_{BE}$ (132) for the compensation of varying B1-product is shown in FIG. 19. The input $E_S$ (22) of the three-port is connected via a linear system (integration element 129) and via a nonlinear transfer element $N_{BE}$ (130) without memory to the input of the multiplier (131). The input $E_1$ (21) is connected to the other multiplier input. The output of the multiplier (131) is connected to the output A (25) of the three-port $D_{BE}$ (132).

The three-port $D_{SE}$ (124 in FIG. 17) compensates for the displacement varying stiffness of the suspension. The input $E_2$ (22) of the three-port $D_{SE}$ is connected via an integration element (123), via a nonlinear transfer element $N_{SE}$ (122) without memory and via a linear two-port Q (121) to the input of a summing element (103). The input $E_1$ (21) is connected to the second input of the summing element and the output of (103) is connected to the output A (25) of the three-port $D_{SE}$.

The three-port $D_{DE}$ (125 in FIG. 18) compensates for the displacement varying damping. The input $E_2$ (22) of the three-port is connected both to the first input of the multiplier (107) directly and via an linear system (integration element 126) and via nonlinear transfer element $N_{DE}$ (128) without memory to the second input of the multiplier (107). The output of the multiplier is connected via a linear two-port Q (121) to the input of an summing element (103). The input $E_1$ (21) is connected to the second input of the summing element (103) and the output of the summing element (103) is connected to the output A (25) of the three-port $D_{DE}$ (125).

In case of an electrostatic sensor (condenser microphone), nonlinear distortion in the signal is caused by several elements. Additional capacity $C_p$ switched in parallel to the measuring capacity $C_0$, the electric attraction force, the compliance of the suspension, and the enclosed air, all of which vary with displacement.

These relatively small nonlinearities can also be compensated by a distortion reduction network. The diaphragm with the surface $S_M$ transforms the sound pressure signal $p_m(t)$ into a force signal F(t). Since the moving mass can be neglected in the frequency range of interest, this force works against the total stiffness of diaphragm suspension.

The total stiffness takes into account the stiffness of the diaphragm $s_T(x)$, the stiffness of enclosed air $s_B(x)$ and the effect of the electrical attraction force. With respect to nonlinear distortion reduction, the total stiffness is split into a constant part $s_o$ and into varying part $s_G(x)$:

$$s_0+s_G(x)=s_T(x)+s_B(X)+s_A(x,U_0). \tag{70}$$

A polarization voltage $U_0$ is applied between the diaphragm and the counter-electrode of the electrostatic sensor. The high input impedance of the amplifiers provides a constant charge at the electrodes. However, there is a charge flow between the displacement varying capacity $C_0$ (diaphragm and counter electrode) and additional constant parallel capacity $C_P$ due to the design. This results in a nonlinear relation between displacement x(t) and output voltage $$U_L(t) = U_0 \bullet \left( \frac{C_0 + C_P}{C_P + C_0 \frac{x_0 - x}{x_0}} - 1 \right) \tag{71}$$

By connecting a distortion reduction system with the transfer function $$u(t)=f(u_L(t)) \tag{72}$$

in series to the microphone, the total system can be linearized and the following transfer function is obtained:

$$U(t) = \frac{U_0 \bullet F(t)}{x_0 \bullet s_0} \tag{73}$$

By combining equations (60)–(62), the transfer of the nonlinear distortion reduction network $$u(t) = N_K(u_L(t)) = \frac{U_0 \bullet x}{x_0} \left( 1 + \frac{s_G(x)}{s_0} \right) \tag{74}$$

with $$x = x_0 \bullet \left( 1 + \frac{C_P}{C_0} \right) \bullet \left( 1 - \frac{U_0}{u_L(t)} \right) \tag{75}$$

can be derived. The distortion reduction network is a nonlinear two-port without memory (independent of frequency).

After deriving the circuit structures of nonlinear distortion reduction networks for different electroacoustic transducers, the problem of fitting the distortion reduction network to the transducer is solved.

According to the invention, linear and nonlinear element parameters of the nonlinear distortion reduction system can be changed by control signals. After parameter adjustment, optimal values for the control elements are stored. During the adjustment procedure, an additional adjustment system (shown in FIG. 22) is activated. It contains a generator (75) to produce an excitation signal, a sensor (3) and an analyzer (76) to measure a signal at the transducer (2) and to determine the optimal control signals for parameter adjustment. The adjustment system can be realized as a feed forward or a feed back system.

In a feed forward adjustment system, the transducer is directly connected with the signal generator. When the transducer is driven with a special excitation signal, an acoustical, mechanical, or an electrical signal is measured at the transducer. Direct measurement of displacement or of the sound pressure in the near field requires an additional sensor. The measured transfer behavior of the transducer provides the linear and nonlinear parameters, and they are transformed into the appropriate parameters of the distortion reduction system. After the parameter adjustment, the distortion reduction system is connected to the transducer. High accuracy is required in the parameter measurement separated from parameter adjustment.

Figure 22:
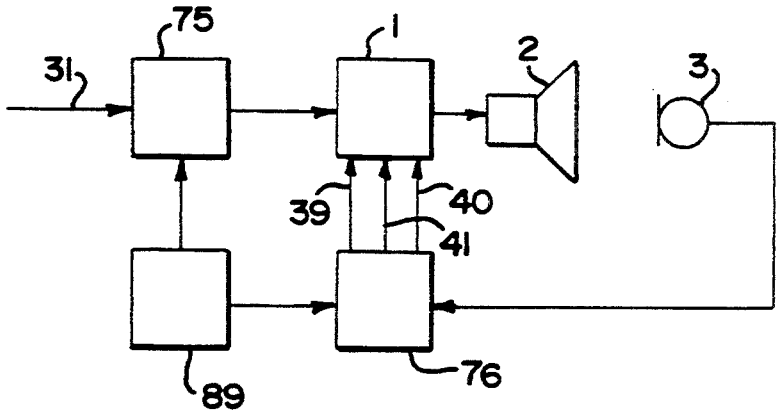
FIG. 22: Basic structure of the adjustment system to perform an automatic fitting of the distortion reduction network to the transducer.

The adjustment system also can be realized as a feed back system. (as shown in FIG. 22). In this system, the distortion reduction system (1) is switched between generator (75) and transducer (2). The measuring signal picked up with sensor (3) is fed back via an analyzer (76) to control inputs (39,40,41) of the adjustable distortion reduction elements.

At the beginning of the adjustment, the main control system (89) disconnects the input of the distortion reduction system (1) from the external signal source (31) and connects it with the generator (75). When the control signals reach a steady state and the total system distortion is minimized, the adjustment is finished. The signal input is reconnected to the external signal source.

The analyzer derives the control signals (39,40,41) from the measured transfer behavior by performing a spectral or correlation analysis. Using correlation analysis, the measuring signal is correlated with a distortion signal synthesized from the excitation signal by a nonlinear system which corresponds to the transducer model. Frequency and phase are of importance for the correlation analysis, not amplitude.

The parameter adjustment is performed at different amplitudes of excitation signals to achieve good compensation over the range of small to large signals.

The invention shall be explained in detail as follows with the help of an executed example and the FIGS. 20, 21, 22 and 23. A simple example was chosen for reasons of clarity. The principle is transferrable to transducers with more nonlinear mechanisms.

Figure 20B:
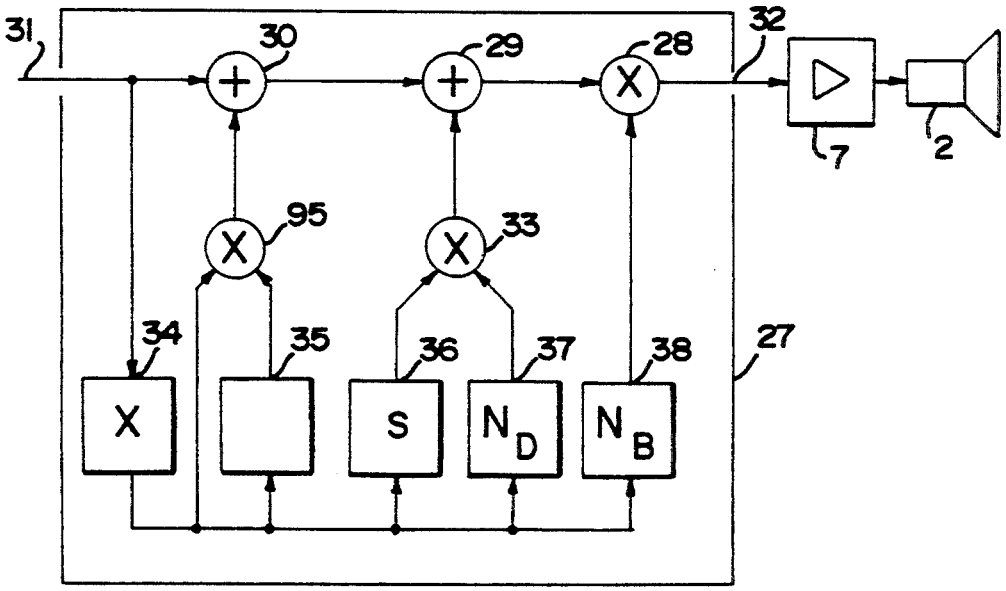
FIG. 20*b*: Distortion reduction network for a loudspeaker system.

An electro-dynamic transducer (2), which is mounted in a closed box, is supplied with constant current. Since the varying B1-product is the dominant distortion mechanism for this loudspeaker, only one nonlinear transducer parameter requires compensation. The appropriate distortion reduction network is shown in FIG. 20*b*. It corrects the B1-product, the stiffness of suspension and the damping of the transducer. The network comprises a linear filter X (34) with second order low-pass characteristic, a differentiator s (36), three nonlinear two ports $N_S$ (35), $N_B$ (38), $N_D$ (37) without memory, three multipliers (33,28,95) and two summing elements (29, 30).

The input of the summing element (30) and the input of the low-pass X (34) are connected to the input (31) of the distortion reduction network. The displacement equivalent signal x(t) at the output of the low-pass X (34) is connected to all inputs of the nonlinear two-ports (35,37,38), to the differentiator (36) and to one input of the multiplier (95). The second input of the multiplier (95) is connected to the output of the nonlinear two-port $N_S$(35). The output of the multiplier (95) is summed with the undistorted input signal at summing element (30). The output of the differentiator (36) and the output of the nonlinear two-port $N_D$ (37) are multiplied at (33) and the result is added to the output of summing element of (30). The output of the two-port $N_B$ (38) is multiplied with the output of the summing element (29) and supplied via an amplifier (7) with constant current supply to the loudspeaker.

The linear network X (34) can be realized as an active RC-filter. Its loss factor and resonance frequency are adjusted to match the desired values of the total system (transducer with filter). The response of the low-pass X(s) must be identical to the total arrangement to permit the correct function of the nonlinear distortion reduction system. The adjustment of the linear behavior is performed by the three-ports $D_D$ and $D_S$. Insertion of an constant value into the correction functions $N_S$ and $N_D(x)$ of the nonlinear elements (35) and (37), the loss factor and resonance frequency of the transducer can be virtually shifted. Since the transducer in this example does not show stiffness and suspension nonlinearities, no variable value is required for $N_S(x)$ and $N_D(x)$. The nonlinear function $N_B(x)$ of the two-port (38) must be fit to the transducer.

Figure 21:
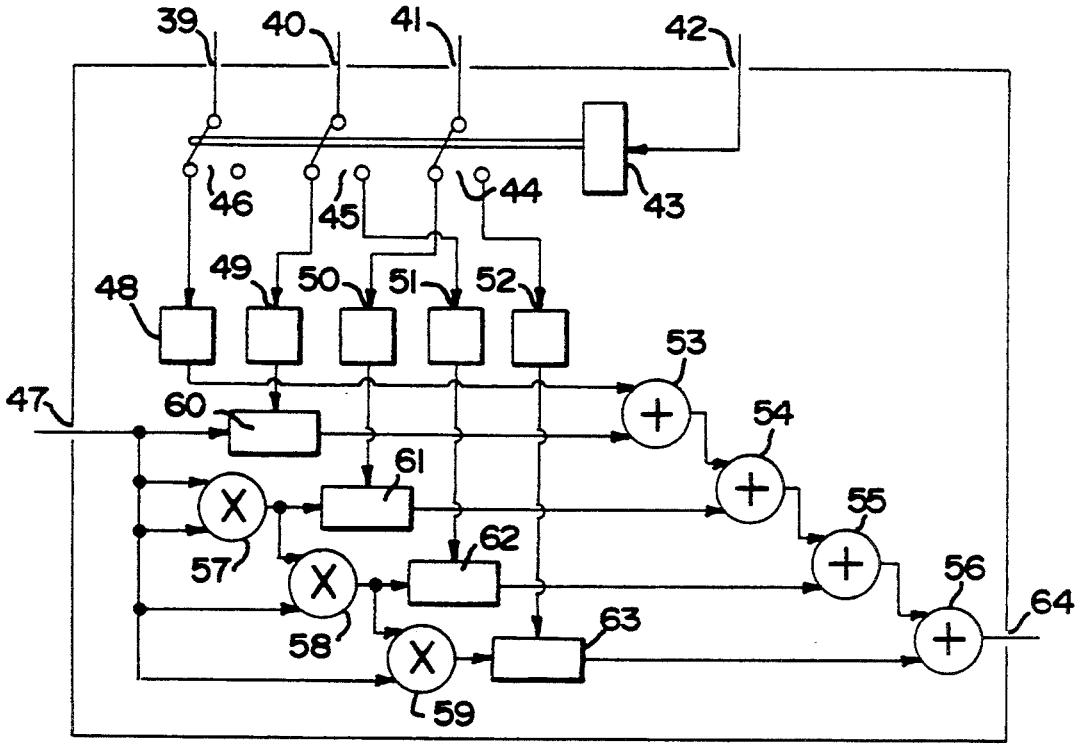
FIG. 21: Circuit of a controllable nonlinear two-port without memory.

The nonlinear two-ports (35, 37, 38) are configured as shown in FIG. 21 using a parallel circuit of single branches to realize the terms of a power series. Each branch uses multiplying elements (57,58,59) to generate its term for the required power series. The coefficients are realized by voltage controlled amplifiers (VCA) (60,62,63). The branches (terms) are summed by summing elements (53,54,55,56) and result in the output signal (64). Coefficient modification by a VCA allows an approximation of the required correction curve. Storage elements (48,49,50,51,52) are connected between the control inputs and the VCA, which store the optimum control value after the parameter fitting. The control voltages of the linear branch (49,60) and of the cubic branch (51,58,62) change the asymmetry of the correction curve. The even order terms are responsible for the symmetric variation of the correction curve.

The even and odd control lines (40, 41) are connected at switches (44,45) to the second or fourth order and first or third order respectively. They are simultaneously switched from the main control circuit (89) via a relay (43). The coefficients of the linear (48) and second order (50) branches are optimized for small signals. At higher signal levels the higher order terms are adjusted by switching control lines (40, 41) to the third- and fourth-order branches.

Figure 23:
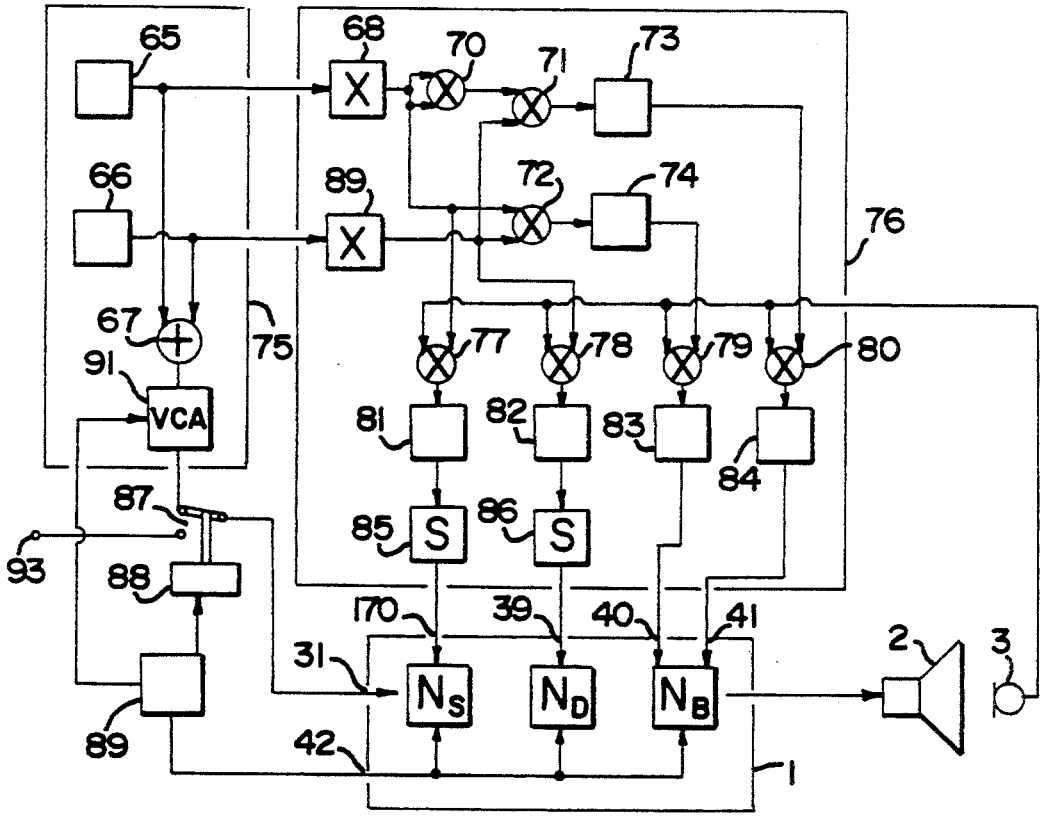
FIG. 23: Circuit of the automatic adjustment system based on correlation analysis.

Referring to FIG. 23, the adjustment system utilizes two signal generators (65,66), which create a sinusoidal signal close to the resonance frequency and a second tone at higher frequency. Both tones are mixed in the summing element (67) and transferred to the distortion-reduction network (1) via a voltage controlled amplifier (91) and switch (87). The main control block (89) controls this operation during the fitting via the relay (88) and after the fitting switches back to the external signal input (93). The distortion-reduction network (1) is connected to the transducer (2) via a DC coupled amplifier with voltage-current converter (7).

During the fitting process the sound pressure is measured close to the loudspeaker by a microphone (3). The microphone signal is transferred to the analyzer (76). The analyzer contains a correlator for each parameter requiring adjustment. The correlators are constructed of a multiplier (77,78,79,80) and a postconnected low-pass filter (81,82,83,84). One of the correlator inputs receives the microphone signal, the other input receives a reference distortion signal derived from the signal generators. The amplitude of the reference signals is arbitrary and does not carry any informative value. The frequency and phase of the reference signals are compared with the fundamental, harmonic and intermodulation components of the microphone signal.

The reference signals $R(f_1)$ and $R(f_2)$ at the inputs of the multipliers (77, 78) are synthesized by linear filters (68, 89) with the transfer function X(s).

The reference signal R(f1) is multiplied with the microphone signal at the correlator (77,81) and the output signal is transferred via a differentiator (85) to the control input (39) of the nonlinear two-port for stiffness compensation.

The reference signal R(f2) is multiplied with the microphone signal at the correlator (78,82) and the output signal is transferred via the differentiator (86) to the control input of the nonlinear two-port for damping compensation.

The constant values for the nonlinear two-ports $N_S$ and $N_D$ are determined by maximizing the output signals at the correlators (81, 82). The linear behavior of the total system (loss factor and the resonance frequency) is adjusted to the predetermined values of the linear filter X(s) (34, 68, 89).

The reference signals R(f1+f2) and R(2*f1+f2) are synthesized by a model of the nonlinear transducer.

The signals f1 and f2 are transferred through linear filters X (68,89), then multiplied in the multiplier (72) with each other and then again filtered through the linear transfer function of the transducer (74). The resulting reference signal R(f1+f2) is equal in phase and frequency to the intermodulation caused by asymmetry in the B1-product curve (Klippel, W., Dynamic Measurement of Nonlinear Parameters of Electro-dynamic Loudspeakers and Their Interpretation, 88 Cony. of the Audio Eng.Soc., March 1990, preprint 2903. The reference signal R(2*f1+f2) is synthesized by multiplying the signal f2 with the squared signal f1 at (70, 71).

The output signals (71, 72) are linearly filtered (73, 74) with the transfer function of the low-pass X.

The reference signal R(f1+f2) is correlated with the microphone signal (79,83), then is transferred to the asymmetric control input (40) of the nonlinear two-port $N_B$ for B1-product compensation. The reference signal $R(2f_1+f_2)$ is correlated with the microphone signal (80,84), then is transferred to the symmetric input (41) of the nonlinear two-port $N_B$.

The correction curve shape is modified when the intermodulation products of second and third order are reduced and the output signal of the integrating elements (83) and (84) approaches zero. The sign of the correlation output shows an over- or under compensation of the distortion reduction network, and results in decreasing or increasing of control signal at (40, 41).

After starting the fitting process, the main control system (89) connects the input (31) of the distortion reduction system to the generator (75) and activates the lowest amplitude of the excitation signal via the voltage controlled amplifier (91). It then starts fitting the constants into the nonlinear functions $N_D(x)$ and $N_D(x)$ are stored the optimum control values in (48). At the same time coefficients for the linear and second order branches of the two-port $N_B$ are changed and the optimum voltage in the retaining circuits (49,50) are stored. When the system reaches steady state, the main control system (89) activates higher order branches in the two-port $N_B$ by switching (44,45). The amplitude of the excitation signal is increased to determine the optimum values for (51,52). The constant values of the two-ports $N_S$ and $N_D$ stored in (48) are not changed. The main control system deactivates the generator (75) and connects the input of the distortion reduction network (31) to the external signal input (93).

I claim:

1. A network for the correction of linear and nonlinear transfer characteristics of electro-acoustic transducers over the complete dynamic range of small and large input signal amplitudes comprising:

an electro-acoustic transducer having an input;

a distortion reduction system with nonlinear transfer characteristics that are inverse to the same nonlinear transfer characteristics of the transducer and being connected to the input of said transducer;

said distortion reduction system consisting of at least two two-port distortion reduction circuits connected in series with each other containing predetermined elements to correct predetermined types of distortion, said system having an input for receiving said input signal amplitudes and generating an output to the input of said transducer;

each of said two-port distortion reduction circuits containing at least one three-port circuit as said predetermined elements, each of said three-port circuits having first and second inputs and an output;

said distortion reduction system containing adjustable control elements coupled to each of said two-port distortion reduction circuits to correct distortion using said nonlinear transfer characteristics that are inverse to those same characteristics of the transducer; and wherein the transfer characteristics of each of said two-port distortion reduction circuits adjusts said input signals such that the output of said distortion reduction system provides an input to the transducer to compensate for the nonlinear behavior of the electro-acoustic transducer.

2. The network according to claim 1 wherein a plurality of said three-port circuits are contained in at least one of said two-port distortion reduction circuits and are connected in a feedback arrangement.

3. The network according to claim 2 wherein:

the first input of the first one of said plurality of three-port circuits is connected as the input of the two-port distortion reduction circuit;

the output of the first three-port circuit is connected to the first input of a second following three-port circuit;

at least one additional three-port circuit being connected in the same manner as the first and second three-port circuits resulting in a series connection of all of said three-port circuits;

the output of the last one of the plurality of three-port circuits is connected as the output of the two-port distortion reduction circuit; and the second input of all of the plurality of three-port circuits in each of said two-port distortion reduction circuits is connected to the output of a respective two-port distortion reduction circuit to provide a feedback signal path.

4. The network according to claim 1 wherein a plurality of series connected three-port circuits are contained in at least one of said two-port distortion circuits and are connected in a feed forward arrangement.

5. The network of claim 4 wherein:

the first input of a first three-port circuit forms the input of the two-port distortion reduction circuit;

the output of the first three-port circuit is connected to the first input of the succeeding three-port circuit;

at least one additional three-port circuit being connected in the same manner as said first and second three-port circuits, resulting in a series connection of all three-port circuits;

the output of the last three-port circuit being connected as the output of the two-port distortion reduction circuit; and the second input of all three-port circuits being connected to the input of the two-port distortion reduction circuit to form said feed forward arrangement.

6. The network according to claim 1 wherein the three-port circuit is comprised of:

a linear two-port dynamic distortion reduction circuit and a nonlinear two-port distortion reduction circuit without memory, in series;

the input of the linear two-port distortion reduction circuit forming the first input of the three-port circuit;

a summing element having first and second inputs and an output;

the output of the nonlinear two-port distortion reduction circuit connected as a first input to said summing element;

the second input of the three-port circuit being connected to the second input of said summing element; and the output of the summing element forming the output of the three-port circuit.

7. The network according to claim 1 wherein said three-port circuit compensates for the displacement varying B1-product and is comprised of:

a linear two-port dynamic distortion reduction circuit and a nonlinear two-port distortion reduction circuit without memory, in series;

the input of the linear two-port distortion reduction circuit being connected as the first input of the three-port circuit;

a multiplying element having first and second inputs and an output;

the output of the nonlinear two-port distortion reduction circuit being connected to said first input of said multiplying element;

the second input of the three-port circuit connected to the second input of the combining element; and the output of the combining element forming the output of the three-port circuit.

8. The network according to claim 1 for compensating for the displacement varying damping of a woofer system wherein the three-port circuit is comprised of:

a first linear two-port distortion reduction circuit whose input forms the first input of said three-port circuit;

a multiplier having first and second inputs and an output;

a second linear two-port distortion reduction circuit;

a nonlinear two-port distortion reduction circuit without memory and having an input and an output;

the output of said first linear two-port distortion reduction circuit being connected to the input of said second linear two-port distortion reduction circuit and to the input of said nonlinear two-port distortion reduction circuit;

the output of said nonlinear two-port distortion reduction circuit without memory being coupled to the first input of said multiplier;

the output of said nonlinear two-port distortion reduction circuit without memory being connected to said second input of said multiplier;

a summing element having first and second inputs and an output;

the output of said multiplier being connected to the first input of said summing element;

the second input of said three-port circuit being connected to said second input of said summing element; and said output of said summing element forming said output of said three-port circuit.

9. The network according to claim 1 for compensating for the electromagnetic attraction force of a woofer system driven by a voltage source and wherein said three-port circuit comprises:

a first linear two-port distortion reduction circuit having an input and an output and whose input forms said first input of the three-port circuit;

a first nonlinear two-port distortion reduction circuit having an input and an output;

a squaring element having first and second inputs and an output;

said input to the three-port circuit being also connected to the input of said first nonlinear two-port distortion reduction circuit whose output is coupled to both said first and second inputs of said squaring element;

a multiplier having first and second inputs and an output;

said output of said squaring element being connected to said first input of said multiplier;

a second nonlinear two-port distortion reduction circuit;

the output of said first linear two-port distortion reduction circuit being connected via said second nonlinear two-port distortion reduction circuit to said second input of said multiplier;

a summing element having first and second inputs and an output;

the output of said multiplier being connected to said first input of said summing element;

the second input of said three-port circuit being connected to said second input of said summing element; and said output of said summing element forming said output of said three-port circuit.

10. The network according to claim 1 for compensating for the electromagnetic attraction force of a woofer system driven by a current source wherein said three-port circuit is comprised of:

a linear two-port distortion reduction circuit and having an input and an output and whose input forms said first input of said three-port circuit;

a squaring element having first and second inputs and an output;

said first input of said three-port circuit also being directly connected to both said first and second inputs of said squaring element;

a multiplier having first and second inputs and an output;

said output of said squaring element being connected to said first input of said multiplier;

a nonlinear two-port distortion reduction circuit without memory having an input and an output;

said output of said linear two-port distortion reduction circuit being connected via said nonlinear two-port distortion reduction circuit to said second input of said multiplier;

a summing element having first and second inputs and an output;

the output of said multiplier being connected to said first input of said summing element;

said second input of said three-port circuit being connected to said second input of summing element; and said output of said summing element forming said output of said three-port circuit.

11. The network according to claim 1 for compensating for the displacement varying damping of an electrodynamic microphone wherein said three-port circuit is comprised of:

a linear two-port integrating element having an input and an output and whose input is connected as the first input of said three-port circuit;

a multiplying element having first and second inputs and an output;

said first input of the three-port circuit also being connected directly to said first input of said multiplying element;

a nonlinear two-port distortion reduction circuit without memory and having an input and an output;

said output of said linear two-port integrating element being connected via said nonlinear two-port distortion reduction circuit without memory to said second input of said multiplying element;

a linear transfer two-port element having an input and an output;

a summing element having first and second inputs and an output;

the output of said multiplier being connected via said linear transfer two-port element to said first input of said summing element;

said second input of said three-port circuit being connected to said second input of said summing element; and said output of said summing element forming said output of said three-port circuit.

12. The network according to claim 1 for compensating for displacement varying inductance of a woofer system wherein said three-port circuit is comprised of:

a first linear transfer two-port distortion reduction circuit having an input and an output and with the input being said first input of said three-port circuit;

a first nonlinear synthesizing two-port distortion reduction circuit having an input and an output;

a multiplying element having first and second inputs and an output;

said input of said three-port circuit also being connected via said first nonlinear synthesizing two-port distortion reduction circuit to said first input of said multiplying element;

a second nonlinear two-port distortion reduction circuit without memory having an input and an output;

the output of said first linear transfer two-port distortion reduction circuit being connected via said second nonlinear two-port distortion reduction circuit without memory to said second input of said multiplying element;

a second linear transfer two-port distortion reduction circuit having an input and an output;

a summing element having first and second inputs and an output;

the output of said multiplying element being connected via said second linear transfer two-port distortion reduction circuit to said first input of said summing element;

said second input of said three-port circuit being connected to said second input of said summing element; and said output of said summing element forming said output of said three-port circuit.

13. The network according to claim 1 for compensating for nonlinear air compression in sound directing elements wherein said three-port circuit is comprised of:

a dynamic two-port distortion reduction circuit and having an input and an output, said input forming said input of said three-port circuit;

a nonlinear two-port distortion reduction circuit without memory having an input connected to said output of said dynamic two-port distortion reduction circuit and an output;

a linear transfer two-port distortion reduction circuit having an input coupled to the output of said nonlinear two-port distortion reduction circuit;

a summing element having first and second inputs and an output, said first input of said summing element being coupled to the output of said linear transfer two-port distortion reduction circuit;

the second input of said three-port circuit being connected to said second input of said summing element; and said output of said summing element forming said output of said three-port circuit.

14. The network according to claim 1 for compensating for the varying flow resistance due to turbulence and sound directing elements wherein said three-port circuit is comprised of:

a first linear transfer two-port distortion reduction circuit having an input forming the first input of said three-port circuit and an output;

a nonlinear two-port distortion reduction circuit without memory having an input coupled to the output of said first linear transfer two-port distortion reduction circuit and an output;

a second linear transfer two-port distortion reduction circuit having an input coupled to said output of said nonlinear two-port distortion reduction circuit and an output;

a summing element having first and second inputs and an output, said first output of said summing element being connected to the output of said second linear transfer two-port distortion reduction circuit;

said second input of said summing element being connected to said second input of said three-port circuit; and said output of said summing element forming said output of said three-port circuit.

15. The network according to claim 1 for compensating for the displacement varying stiffness of an electromagnetic microphone wherein said three-port circuit is comprised of:

an integration two-port distortion reduction circuit having an input and an output and whose input forms said first input of said three-port circuit;

a nonlinear two-port distortion reduction circuit without memory and having an input and an output;

the output of said integration two-port distortion reduction circuit being connected to said input of said nonlinear two-port distortion reduction circuit without memory;

a linear transfer two-port distortion reduction circuit having an input and an output;

said output of said nonlinear two-port distortion reduction circuit without memory being connected to said input of said linear transfer two-port distortion reduction circuit;

a summing element having first and second inputs and an output;

the output of said linear transfer two-port distortion reduction circuit being connected to said first input of said summing elements;

the second input of the summing element being connected to said second input of said three-port circuit; and the output of said summing element forming the output of said three-port circuit.

16. The network according to claim 1 for compensating for the displacement varying B1-product of an electro-dynamic microphone wherein said three-port circuit is comprised of:

an integrating two-port distortion reduction circuit having an input and an output and whose input forms said first input of said three-port circuit;

a nonlinear two-port distortion reduction circuit without memory and having an input and an output;

said output of said integrating two-port distortion reduction circuit being connected to the input of said nonlinear two-port distortion reduction circuit without memory;

a multiplying element having first and second inputs and an output;

the output of said nonlinear two-port distortion reduction circuit without memory being connected to said first input of said multiplying element;

the second input of said multiplying element forming said second input to said three-port circuit; and said output of said multiplying element forming the output of said three-port circuit.

17. The network of claim 1 wherein said three-port circuit is comprised of:

a nonlinear two-port distortion reduction circuit without memory and having an input and an output, said nonlinear two-port circuit input forming said first input of the three-port circuit; and a combining element without memory and having first and second inputs and an output, said combining element combining said second input to said three-port circuit with said output of said nonlinear two-port distortion reduction circuit without memory into the output signal of the three-port circuit by use of a mathematical operation.

18. The network of claim 17 wherein the two-port distortion reduction circuit is comprised of a combination of linear two-port distortion reduction circuits, nonlinear two-port distortion reduction circuit without memory and combining elements without memory.

19. A network for the correction of linear and nonlinear transfer characteristics of electro-acoustic transducers over the complete dynamic range of small and large input signal amplitudes comprising:

an electro-acoustic transducer having an input;

a distortion reduction system with nonlinear transfer characteristics that are inverse to the same nonlinear transfer characteristics of the transducer and being connected to the input of said transducer;

said distortion reduction system consisting of at least one two-port distortion reduction circuit containing predetermined means to correct predetermined types of distortion and having an input for receiving said input signal amplitudes and generating an output to the input of said transducer;

each of said two-port distortion reduction circuits containing at least one three-port circuit with feedback as said predetermined means, each of said three-port circuits having first and second inputs and an output;

said distortion reduction system containing adjustable control elements coupled to each of said two-port distortion reduction circuits to correct distortion using said nonlinear transfer characteristics that are inverse to those same characteristics of the transducer; and wherein the transfer characteristics of each of said two-port distortion reduction circuits adjusts said input signals such that the output of said distortion reduction system provides an input to the transducer to compensate for the nonlinear behavior of the electro-acoustic transducer.

20. The network of claim 19 wherein:

each of said two-port distortion reduction circuits comprises a plurality of three-port circuits arranged with feedback;

the first input of the first one of said plurality of three-port circuits forms the input of the two-port distortion reduction circuit;

the output of the first three-port circuit is connected to the first input of a second following three-port circuit;

at least one additional three-port circuit being connected in the same manner as the first and second three-port circuits resulting in a series connection of all of said three-port circuits;

the output of the last one of said plurality of three-port circuits forming the output of the two-port distortion reduction circuit; and the second input of all of said plurality of three-port circuits being connected to the output of the two-port distortion reduction circuit to provide a feedback signal path.

21. The network according to claim 19 wherein the three-port circuit is comprised of:

a linear two-port dynamic distortion reduction circuit and a nonlinear two-port distortion reduction circuit without memory, in series;

the input of the linear two-port distortion reduction circuit forming the first input of the three-port circuit;

a summing element having first and a second inputs and an output;

the output of the nonlinear two-port distortion reduction circuit being connected to the first input of said summing element;

the second input of the three-port circuit being connected to the second input of the summing element; and the output of the summing element forming said output of the three-port circuit.

22. The network according to claim 19 wherein the three-port circuit compensates for the displacement varying B1-product and is comprised of:

a linear two-port dynamic distortion reduction circuit and a nonlinear two-port distortion reduction circuit without memory, in series;

the input of the linear two-port distortion reduction circuit forming the first input of the three-port circuit;

a multiplying element having first and second inputs and an output;

the output of the nonlinear two-port distortion reduction circuit being connected to said first input of said multiplying element;

the second input of said three-port circuit being connected to the second input of said combining element; and the output of said combining element forming the output of the three-port circuit.

23. The network according to claim 19 for compensating for the displacement varying damping of a woofer system wherein the three-port circuit is comprised of:

a first linear two-port distortion reduction circuit whose input forms the first input of said three-port circuit;

a multiplier having first and second inputs and an output;

a second linear two-port distortion reduction circuit;

a nonlinear two-port distortion reduction circuit without memory and having an input and an output;

the output of said first linear two-port distortion reduction circuit being connected to the input of said second linear two-port distortion reduction circuit and to the input of said nonlinear two-port distortion reduction circuit;

the output of said nonlinear two-port distortion reduction circuit without memory being coupled to the first input of said multiplier;

the output of said nonlinear two-port distortion reduction circuit without memory being connected to said second input of said multiplier;

a summing element having first and second inputs and an output;

the output of said multiplier being connected to the first input of said summing element;

the second input of said three-port circuit being connected to said second input of said summing element; and said output of said summing element forming said output of said three-port circuit.

24. The network according to claim 19 for compensating for the electromagnetic attraction force of a woofer system driven by a voltage source and wherein the three-port circuit is comprised of:

a first linear two-port distortion reduction circuit having an input and an output and whose input forms said first input of the three-port circuit;

a first nonlinear two-port distortion reduction circuit having an input and an output;

a squaring element having first and second inputs and an output;

said input to the three-port circuit being also connected to the input of said first nonlinear two-port distortion reduction circuit whose output is coupled to both said first and second inputs of said squaring element;

a multiplier having first and second inputs and an output;

said output of said squaring element being connected to said first input of said multiplier;

a second nonlinear two-port distortion reduction circuit;

the output of said first linear two-port distortion reduction circuit being connected via said second nonlinear two-port distortion reduction circuit to said second input of said multiplier;

a summing element having first and second inputs and an output;

the output of said multiplier being connected to said first input of said summing element;

the second input of said three-port circuit being connected to said second input of said summing element; and said output of said summing element forming said output of said three-port circuit.

25. The network according to claim 19 for compensating for the electromagnetic attraction force of a woofer system driven by a current source wherein said three-port circuit is comprised of:

a linear two-port distortion reduction circuit and having an input and an output and whose input forms said first input of said three-port circuit;

a squaring element having first and second inputs and an output;

said first input of said three-port circuit also being directly connected to both said first and second inputs of said squaring element;

a multiplier having first and second inputs and an output;

said output of said squaring element being connected to said first input of said multiplier;

a nonlinear two-port distortion reduction circuit without memory having an input and an output;

said output of said linear two-port distortion reduction circuit being connected via said nonlinear two-port distortion reduction circuit to said second input of said multiplier;

a summing element having first and second inputs and an output;

the output of said multiplier being connected to said first input of said summing element;

said second input of said three-port circuit being connected to said second input of summing element; and said output of said summing element forming said output of said three-port circuit.

26. The network according to claim 19 for compensating for the displacement varying damping of an electro-dynamic microphone wherein said three-port circuit is comprised of:

a linear two-port integrating element having an input and an output and whose input is connected as the first input of said three-port circuit;

a multiplying element having first and second inputs and an output;

said first input of the three-port circuit also being connected directly to said first input of said multiplying element;

a nonlinear two-port distortion reduction circuit without memory and having an input and an output;

said output of said linear two-port integrating element being connected via said nonlinear two-port distortion reduction circuit without memory to said second input of said multiplying element;

a linear transfer two-port element having an input and an output;

a summing element having first and second inputs and an output;

the output of said multiplier being connected via said linear transfer two-port element to said first input of said summing element;

said second input of said three-port circuit being connected to said second input of said summing element; and said output of said summing element forming said output of said three-port circuit.

27. The network according to claim 19 for compensating for displacement varying inductance of a woofer system wherein said three-port circuit is comprised of:

a first linear transfer two-port distortion reduction circuit having an input and an output and with the input being said first input of said three-port circuit;

a first nonlinear synthesizing two-port distortion reduction circuit having an input and an output;

a multiplying element having first and second inputs and an output;

said input of said three-port circuit also being connected via said first nonlinear synthesizing two-port distortion reduction circuit to said first input of said multiplying element;

a second nonlinear two-port distortion reduction circuit without memory having an input and an output;

the output of said first linear transfer two-port distortion reduction circuit being connected via said second nonlinear two-port distortion reduction circuit without memory to said second input of said multiplying element;

a second linear transfer two-port distortion reduction circuit having an input and an output;

a summing element having first and second inputs and an output;

the output of said multiplying element being connected via said second linear transfer two-port distortion reduction circuit to said first input of said summing element;

said second input of said three-port circuit being connected to said second input of said summing element; and said output of said summing element forming said output of said three-port circuit.

28. The network according to claim 19 for compensating for nonlinear air compression in sound directing elements wherein said three-port circuit is comprised of:

a dynamic two-port distortion reduction circuit and having an input and an output, said input forming said input of said three-port circuit;

a nonlinear two-port distortion reduction circuit without memory having an input connected to said output of said dynamic two-port distortion reduction circuit and an output;

a linear transfer two-port distortion reduction circuit having an input coupled to the output of said nonlinear two-port distortion reduction circuit;

a summing element having first and second inputs and an output, said first input of said summing element being coupled to the output of said linear transfer two-port distortion reduction circuit;

the second input of said three-port circuit being connected to said second input of said summing element; and said output of said summing element forming said output of said three-port circuit.

29. The network according to claim 19 for compensating for the varying flow resistance due to turbulence and sound directing elements wherein said three-port circuit is comprised of:

a first linear transfer two-port distortion reduction circuit having an input forming the first input of said three-port circuit and an output;

a nonlinear two-port distortion reduction circuit without memory having an input coupled to the output of said first linear transfer two-port distortion reduction circuit and an output;

a second linear transfer two-port distortion reduction circuit having an input coupled to said output of said nonlinear two-port distortion reduction circuit and an output;

a summing element having first and second inputs and an output, said first output of said summing element being connected to the output of said second linear transfer two-port distortion reduction circuit;

said second input of said summing element being connected to said second input of said three-port circuit; and said output of said summing element forming said output of said three-port circuit.

30. The network according to claim 19 for compensating for the displacement varying stiffness of an electromagnetic microphone wherein said three-port circuit is comprised of:

an integration two-port distortion reduction circuit having an input and an output and whose input forms said first input of said three-port circuit;

a nonlinear two-port distortion reduction circuit without memory and having an input and an output;

the output of said integration two-port distortion reduction circuit being connected to said input of said nonlinear two-port distortion reduction circuit without memory;

a linear transfer two-port distortion reduction circuit having an input and an output;

said output of said nonlinear two-port distortion reduction circuit without memory being connected to said input of said linear transfer two-port distortion reduction circuit;

a summing element having first and second inputs and an output;

the output of said linear transfer two-port distortion reduction circuit being connected to said first input of said summing elements;

the second input of the summing element being connected to said second input of said three-port circuit; and the output of said summing element forming the output of said three-port circuit.

31. The network according to claim 19 for compensating for the displacement varying B1-product of an electrodynamic microphone wherein said three-port circuit is comprised of:

an integrating two-port distortion reduction circuit having an input and an output and whose input forms said first input of said three-port circuit;

a nonlinear two-port distortion reduction circuit without memory and having an input and an output;

said output of said integrating two-port distortion reduction circuit being connected to the input of said nonlinear two-port distortion reduction circuit without memory;

a multiplying element having first and second inputs and an output;

the output of said nonlinear two-port distortion reduction circuit without memory being connected to said first input of said multiplying element;

the second input of said multiplying element forming said second input to said three-port circuit; and said output of said multiplying element forming the output of said three-port circuit.

32. The network of claim 19 wherein said three-port circuit is comprised of:

a nonlinear two-port distortion reduction circuit without memory and having an input and an output and said input forming said first input of the three-port circuit; and a combining element without memory and having first and second inputs and an output, said combining element combining said second input to said three-port circuit without said output of said nonlinear two-port distortion reduction circuit without memory into the output signal of the three-port circuit by use of a mathematical operation.

33. The network of claim 32 wherein the two-port distortion reduction circuit is comprised of a combination of linear two-port distortion reduction circuits, nonlinear two-port distortion reduction circuits without memory and combining elements without memory.

34. A network for the correction of linear and nonlinear transfer characteristics of electro-acoustic transducers over the complete dynamic range of small and large input signal amplitudes comprising:

an electro-acoustic transducer having an input;

a distortion reduction system with nonlinear transfer characteristics that are inverse to the same nonlinear transfer characteristics of the transducer and being connected to the input of said transducer;

said distortion reduction system consisting of at least one two-port distortion reduction circuit containing predetermined elements to correct predetermined types of distortion and having an input for receiving said input signal amplitudes and generating an output to the input of said transducer;

said at least one two-port distortion reduction circuit comprising at least two three-port circuits as said predetermined elements, each of said three-port circuits having first and second inputs and an output and being connected in a feed forward arrangement;

at least one of said three-port circuits containing means for reducing distortion and multiplier combining means which provides said output from said three port circuit;

said distortion reduction system containing adjustable control elements coupled to each of said two-port distortion reduction circuits to correct distortion using said nonlinear transfer characteristics that are inverse to those same characteristics of the transducer; and wherein the transfer characteristics of said two-port distortion reduction circuit adjusts said input signals such that the output of said distortion reduction network provides an input to the transducer to compensate for the nonlinear behavior of the electro-acoustic transducer.

35. The network according to claim 34 for compensating for the displacement varying damping of a woofer system wherein the three-port circuit is comprised of:

a first linear two-port distortion reduction circuit whose input forms the first input of said three-port circuit;

a multiplier having first and second inputs and an output;

a second linear two-port distortion reduction circuit;

a nonlinear two-port distortion reduction circuit without memory and having an input and an output;

the output of said first linear two-port distortion reduction circuit being connected to the input of said second linear two-port distortion reduction circuit and to the input of said nonlinear two-port distortion reduction circuit;

the output of said nonlinear two-port distortion reduction circuit without memory being coupled to the first input of said multiplier;

the output of said nonlinear two-port distortion reduction circuit without memory being connected to said second input of said multiplier;

a summing element having first and second inputs and an output;

the output of said multiplier being connected to the first input of said summing element;

the second input of said three-port circuit being connected to said second input of said summing element; and said output of said summing element forming said output of said three-port circuit.

36. The network according to claim 34 for compensating for the electromagnetic attraction force of a woofer system driven by a voltage source and wherein the three-port circuit is comprised of:

a first linear two-port distortion reduction circuit having an input and an output and whose input forms said first input of the three-port circuit;

a first nonlinear two-port distortion reduction circuit having an input and an output;

a squaring element having first and second inputs and an output;

said input to the three-port circuit being also connected to the input of said first nonlinear two-port distortion reduction circuit whose output is coupled to both said first and second inputs of said squaring element;

a multiplier having first and second inputs and an output;

said output of said squaring element being connected to said first input of said multiplier;

a second nonlinear two-port distortion reduction circuit;

the output of said first linear two-port distortion reduction circuit being connected via said second nonlinear two-port distortion reduction circuit to said second input of said multiplier;

a summing element having first and second inputs and an output;

the output of said multiplier being connected to said first input of said summing element;

the second input of said three-port circuit being connected to said second input of said summing element; and said output of said summing element forming said output of said three-port circuit.

37. The network according to claim 34 for compensating for the electromagnetic attraction force of a woofer system driven by a current source wherein said three-port circuit is comprised of:

a linear two-port distortion reduction circuit and having an input and an output and whose input forms said first input of said three-port circuit;

a squaring element having first and second inputs and an output;

said first input of said three-port circuit also being directly connected to both said first and second inputs of said squaring element;

a multiplier having first and second inputs and an output;

said output of said squaring element being connected to said first input of said multiplier;

a nonlinear two-port distortion reduction circuit without memory having an input and an output;

said output of said linear two-port distortion reduction circuit being connected via said nonlinear two-port distortion reduction circuit to said second input of said multiplier;

a summing element having first and second inputs and an output;

the output of said multiplier being connected to said first input of said summing element;

said second input of said three-port circuit being connected to said second input of summing element; and said output of said summing element forming said output of said three-port circuit.

38. The network according to claim 34 for compensating for the displacement varying damping of an electrodynamic microphone wherein said three-port circuit is comprised of:

a linear two-port integrating element having an input and an output and whose input is connected as the input of said three-port circuit;

a multiplying element having first and second inputs and an output;

said first input of the three-port circuit also being connected directly to said first input of said multiplying element;

a nonlinear two-port distortion reduction circuit without memory and having an input and an output;

said output of said linear two-port integrating element being connected via said nonlinear two-port distortion reduction circuit without memory to said second input of said multiplying element;

a linear transfer two-port element having an input and an output;

a summing element having first and second inputs and an output;

the output of said multiplier being connected via said linear transfer two-port element to said first input of said summing element;

said second input of said three-port circuit being connected to said second input of said summing element; and said output of said summing element forming said output of said three-port circuit.

39. The network according to claim 34 for compensating for displacement varying inductance of a woofer system wherein said three-port circuit is comprised of:

a first linear transfer two-port distortion reduction circuit having an input and an output and with the input being said first input of said three-port circuit;

a first nonlinear synthesizing two-port distortion reduction circuit having an input and an output;

a multiplying element having first and second inputs and an output;

said input of said three-port circuit also being connected via said first nonlinear synthesizing two-port distortion reduction circuit to said first input of said multiplying element;

a second nonlinear two-port distortion reduction circuit without memory having an input and an output;

the output of said first linear transfer two-port distortion reduction circuit being connected via said second nonlinear two-port distortion reduction circuit without memory to said second input of said multiplying element;

a second linear transfer two-port distortion reduction circuit having an input and an output;

a summing element having first and second inputs and an output;

the output of said multiplying element being connected via said second linear transfer two-port distortion reduction circuit to said first input of said summing element;

said second input of said three-port circuit being connected to said second input of said summing element; and said output of said summing element forming said output of said three-port circuit.

40. The network according to claim 34 for compensating for nonlinear air compression in sound directing elements wherein said three-port circuit is comprised of:

a dynamic two-port distortion reduction circuit and having an input and an output, said input forming said input of said three-port circuit;

a nonlinear two-port distortion reduction circuit without memory having an input connected to said output of said dynamic two-port distortion reduction circuit and an output;

a linear transfer two-port distortion reduction circuit having an input coupled to the output of said nonlinear two-port distortion reduction circuit;

a summing element having first and second inputs and an output, said first input of said summing element being coupled to the output of said linear transfer two-port distortion reduction circuit;

the second input of said three-port circuit being connected to said second input of said summing element; and said output of said summing element forming said output of said three-port circuit.

41. The network according to claim 34 for compensating for the varying flow resistance due to turbulence in sound directing elements wherein said three-port circuit is comprised of:

a first linear transfer two-port distortion reduction circuit having an input forming the first input of said three-port circuit and an output;

a nonlinear two-port distortion reduction circuit without memory having an input coupled to the output of said first linear transfer two-port distortion reduction circuit and an output;

a second linear transfer two-port distortion reduction circuit having an input coupled to said output of said nonlinear transfer two-port distortion reduction circuit and an output;

a summing element having first and second inputs and an output, said first output of said summing element being connected to the output of said second linear transfer two-port distortion reduction circuit;

said second input of said summing element being connected to said second input of said three-port circuit; and said output of said summing element forming said output of said three-port circuit.

42. The network according to claim 34 for compensating for the displacement varying stiffness of an electromagnetic microphone wherein said three-port circuit is comprised of:

an integration two-port distortion reduction circuit having an input and an output and whose input forms said first input of said three-port circuit;

a nonlinear two-port distortion reduction circuit without memory and having an input and an output;

the output of said integration two-port distortion reduction circuit being connected to said input of said nonlinear two-port distortion reduction circuit without memory;

a linear transfer two-port distortion reduction circuit having an input and an output;

said output of said nonlinear two-port distortion reduction circuit without memory being connected to said input of said linear transfer two-port distortion reduction circuit;

a summing element having first and second inputs and an output;

the output of said linear transfer two-port distortion reduction circuit being connected to said first input of said summing elements;

the second input of the summing element being connected to said second input of said three-port circuit; and the output of said summing element forming the output of said three-port circuit.

43. The network according to claim 34 for compensating for the displacement varying B1-product of an electro-dynamic microphone wherein said three-port circuit is comprised of:

an integrating two-port distortion reduction circuit having an input and an output and whose input forms said first input of said three-port circuit;

a nonlinear two-port distortion reduction circuit without memory and having an input and an output;

said output of said integrating two-port distortion reduction circuit, being connected to the input of said nonlinear two-port distortion reduction circuit without memory;

a multiplying element having first and second inputs and an output;

the output of said nonlinear two-port distortion reduction circuit without memory being connected to said first input of said multiplying element;

the second input of said multiplying element forming said second input to said three-port circuit; and said output of said multiplying element forming the output of said three-port circuit.

44. The network according to claim 34 wherein said three-port circuit is comprised of:

a nonlinear two-port distortion reduction circuit without memory and having an input and an output and said input forming said first input of the three-port circuit; and a combining element without memory and having first and second inputs and an output, said combining element combining said second input to said three-port circuit with said output of said nonlinear two-port distortion reduction circuit without memory into the output signal of the three-port circuit by use of a mathematical operation.

45. The network of claim 44 wherein the two-port distortion reduction circuit is comprised of a combination of linear two-port distortion reduction circuits, nonlinear two-port distortion reduction circuits without memory and combining elements without memory.

46. The network of claim 34 wherein:

a plurality of said three-port circuits are connected in said feed forward arrangement;

the first input of the first one of said plurality of three-port circuits is connected to the input of said two-port distortion reduction circuit;

the output of said first one of said plurality of three-port circuits is connected to the first input of a second one of said plurality of three-port circuits;

at least one additional three-port circuit being connected in the same manner as said first and second three-port circuits resulting in a series connection of all of said plurality of three-port circuits;

the output of the last one of said plurality of three-port circuits being connected to the output of the two-port distortion reduction circuit; and the second input of all of said plurality of three-port circuits being connected to the first input of the two-port distortion reduction circuit.

47. The network according to claim 34 wherein the three-port circuit is comprised of:

a linear two-port dynamic distortion reduction circuit and a nonlinear two-port distortion reduction circuit without memory, in series;

the input of the linear two-port distortion reduction circuit forming the first input of the three-port circuit;

a summing element having first and a second inputs and an output;

the output of the nonlinear two-port distortion reduction circuit being connected to the first input of said summing element;

the second input of the three-port circuit being connected to the second input of the summing element; and the output of the summing element forming said output of the three-port circuit.

48. The network according to claim 34 wherein the three-port circuit compensates for the displacement varying B1-product of the transducer and is comprised of:

a linear two-port dynamic distortion reduction circuit and a nonlinear two-port distortion reduction circuit without memory, in series;

the input of the linear two-port distortion reduction circuit forming the first input of the three-port circuit;

a multiplying element having first and second inputs and an output;

the output of the nonlinear two-port distortion reduction circuit being connected to said first input of said multiplying element;

the second input of said three-port circuit being connected to the second input of said combining element; and the output of said combining element forming the output of the three-port circuit.

49. A network for the correction of linear and nonlinear transfer characteristics of electro-acoustic transducers over the complete dynamic range of small and large input signal amplitudes comprising:

an electro-acoustic transducer having an input;

a distortion reduction system with nonlinear transfer characteristics that are inverse to the same nonlinear transfer characteristics of the transducer and being connected to the input of said transducer;

said distortion reduction system also having linear transfer characteristics and consisting of at least one two-port distortion reduction circuit having an input for receiving said input signal amplitUdes and generating an output to the input of said transducer;

said distortion reduction system containing adjustable control elements to correct distortion using said nonlinear transfer characteristics that are inverse to those same characteristics of the transducer;

wherein the linear and nonlinear transfer characteristics of said two-port distortion reduction circuit adjusts said input signals such that the output of said distortion reduction network provides an input to the transducer to compensate for the nonlinear behavior of the electro-acoustic transducer; and including control inputs coupled to the adjustable control elements of the distortion reduction network for providing signals to automatically adjust said control elements.

50. The network according to claim 49 wherein said adjustment system consists of:

at least one signal generator for producing an excitation signal to a transducer, a sensor for measuring the electrical, mechanical, and acoustical signal response from the transducer, and an analyzer for evaluating the resulting signal;

said generator being connected via the distortion reduction network to the transducer to produce a signal based on said excitation signal;

said sensor sensing the output of the transducer produced by said excitation signal and generating an output signal to said analyzer;

a reference signal produced by said at least one generator;

said analyzer evaluating the signal from the sensor by comparing it to said reference signal and generating an output control signal; and the output control signal of said analyzer being connected to said control inputs of the distortion reduction network to adjust automatically said control elements of the distortion reduction network to make the transducer produce the signal expected from the excitation signal and thus improve the performance of the distortion reduction network.

* * * * *